US010504665B2

(12) United States Patent
Jaworek et al.

(10) Patent No.: US 10,504,665 B2
(45) Date of Patent: Dec. 10, 2019

(54) SWITCH

(71) Applicant: Johnson Electric S.A., Murten (CH)

(72) Inventors: Bernhard Jaworek, Hagen (DE); Udo Balgheim, Hückeswagen (DE); Jörg Gaβmann, Dresden (DE)

(73) Assignee: JOHNSON ELECTRIC INTERNATIONAL AG, Murten (CH)

( * ) Notice: Subject to any disclaimer, the term of this patent is extended or adjusted under 35 U.S.C. 154(b) by 214 days.

(21) Appl. No.: 15/419,205

(22) Filed: Jan. 30, 2017

(65) Prior Publication Data

US 2017/0221649 A1 Aug. 3, 2017

(30) Foreign Application Priority Data

Jan. 29, 2016 (DE) ..... 10 2016 101 586
Jan. 29, 2016 (DE) ..... 10 2016 101 587
Jan. 29, 2016 (DE) ..... 10 2016 101 588
Jan. 29, 2016 (DE) ..... 10 2016 101 590

(51) Int. Cl.
*H01H 1/36* (2006.01)
*H01H 1/00* (2006.01)
*H01H 13/52* (2006.01)
*H01H 1/24* (2006.01)

(52) U.S. Cl.
CPC ..... *H01H 1/36* (2013.01); *H01H 1/0015* (2013.01); *H01H 1/242* (2013.01); *H01H 13/52* (2013.01); *H01H 2203/022* (2013.01); *H01H 2215/00* (2013.01); *H01H 2221/036* (2013.01)

(58) Field of Classification Search
CPC ..... H01H 1/36; H01H 1/0015; H01H 13/52
USPC ..... 200/252, 405, 407–409, 521, 550
See application file for complete search history.

(56) References Cited

U.S. PATENT DOCUMENTS 4,012,608 A * 3/1977 Lockard ..... H01H 15/005 200/16 D
5,796,058 A * 8/1998 Aimi ..... H01H 21/18 200/16 D
8,440,927 B2 * 5/2013 Lin ..... H01H 13/36 200/408

(Continued)

FOREIGN PATENT DOCUMENTS

CN 101651056 A 2/2010
DE 2460457 * 6/1976 ..... H01H 1/24

*Primary Examiner* — Edwin A. Leon
*Assistant Examiner* — Iman Malakooti
(74) *Attorney, Agent, or Firm* — Muncy, Geissler, Olds & Lowe, P.C.

(57) ABSTRACT

A switch includes a switch housing having a receiving space, a conductive fixed contact element and a conductive active contact element which are provided in the receiving space and being electrically connected to two terminals of the switch respectively, an actuating member reciprocating movable in a predetermined actuating direction between a rest position and an actuated position, and a conductive spring contact element movable with the actuating element. The spring contact element is in constant contact with the fixed contact element and switched between a state of being in contact with a conductive contact surface of the active contact element and a state of being disconnecting with the conductive contact surface of the active contact element. The actuating element is moved back from the actuated position to the rest position due to spring force of the spring contact element.

17 Claims, 21 Drawing Sheets

(56) References Cited

U.S. PATENT DOCUMENTS

| | | | | |
|---|---|---|---|---|
| 2010/0032270 | A1 | 2/2010 | Spiessl | |
| 2015/0021154 | A1* | 1/2015 | Fangmann | H01H 3/50<br>200/521 |

* cited by examiner

SWITCH

CROSS REFERENCE TO RELATED APPLICATIONS

This non-provisional patent application claims priorities under 35 U.S.C. § 119(a) from Patent Application No. DE102016101586.5 filed in Germany on 29 Jan. 2016, Patent Application No. DE102016101587.3 filed in Germany on 29 Jan. 2016, Patent Application No. DE102016101588.1 filed in Germany on 29 Jan. 2016, and Patent Application No. DE102016101590.3 filed in Germany on 29 Jan. 2016.

FIELD

The present disclosure relates to an electrical switch, in particular to a micro signal switch.

BACKGROUND

Micro signal switches incorporating a spring are known. Such a switch includes an actuating member movable between a resting position and an actuated position, two contacting elements connected to the terminals of the switch, and a contact bridge moving with the actuating member for connecting or disconnecting the two contacting elements. The spring functions to make the actuating member return to the rest position from the manipulated position after the actuating member is manipulated. As the contact bridge and the spring are two separate components, the switch has a larger number of switch components and complicated structure.

SUMMARY

The present disclosure provides a switch including a switch housing having a receiving space, a conductive fixed contact element and a conductive active contact element which are provided in the receiving space and being electrically connected to two terminals of the switch respectively, an actuating member reciprocating movable in a predetermined actuating direction between a rest position and an actuated position, and a conductive spring contact element movable with the actuating element. The spring contact element is in constant contact with the fixed contact element and switched between a state of being in contact with a conductive contact surface of the active contact element and a state of being disconnecting with the conductive contact surface of the active contact element. The actuating element is moved back from the actuated position to the rest position due to spring force of the spring contact element.

Preferably, the spring contact member includes a middle spring part and two limb ends extending from both sides of the middle spring part, one of the limb ends being stationary and in constant contact with the fixed contact element, the other one of the two limb ends being movable with the actuating member along a predetermined path to make contact or disconnect with the active contact element.

Optionally, the middle spring part is sleeved around a holding pin extending in a direction perpendicular to the actuating direction and the movable limb end is movable in the actuating direction to make contact or disconnect with the active contact element.

Optionally, the middle spring part is sleeved around a holding pin extending in a direction perpendicular to the actuating direction and the movable limb end is movable in the direction perpendicular to the actuating direction to make contact or disconnect with the active contact element.

Preferably, the actuating element has a receiving body at the bottom thereof, one of the two limb ends being positioned in the receiving body in a twisted manner under the biasing force of the spring contact element when the actuating element is in the rest position and being further twisted when the actuating member is manipulated.

Optionally, the middle spring part is sleeved around a holding pin extending in a direction parallel to the actuated direction, the movable limb being movable in the direction perpendicular to the actuating direction to make contact or disconnect with the active contact element.

Preferably, the contact of the spring contact element with the active contact element is a sliding contact along the conductive contact surface.

Optionally, the conductive contact surface is parallel to, perpendicular to, or angled with respect to the actuating direction.

Preferably, the conductive contact surface or the switch housing is provided with a haptic sensing structure.

Preferably, a resistor is connected in series between the spring contact element and the fixed contact element or between the spring contact element and the active contact element, the resistor being correspondingly assembled on the fixed contact element or the active contact element.

Preferably, the contact surface has a first contact area extending in a direction inclined with respect to the actuating direction and a second contact area extending in the actuating direction.

Preferably, the movable limb is provided with a plurality of contact points or contact surfaces.

Optionally, the switch is a normally open switch, the movable limb being spaced from the contact surface of the active contact element by a predetermined contact distance when the actuating element is in the rest position.

Preferably, the moving distance of the actuating element in a direction from the resting position to the actuated position is greater than the contact distance between the movable limb and the contact surface of the active contact member.

Optionally, the switch is a normally closed switch, the movable limb being in contact with the active contact element when the actuating element is in the rest position.

Optionally, the active contact element is a first active contact element and the switch is a change-over switch and further comprises a second active contact element which is electrically isolated from the first active contact element and electrically connected to another terminal of the switch, the spring contact element moving with the actuating member to switch between contact with the first active contact element and contact with the second active contact element.

Preferably, the moving distance of the actuating element in a direction from the resting position to the actuated position is greater than the contact distance between the contact surface of the first active contact element and the contact surface of the second active contact member.

Preferably, the switch is provided with a plurality of resistors mounted on a part of or all of the fixed contact element and the first and second active contact elements.

DETAILED DESCRIPTION

Figure 1:
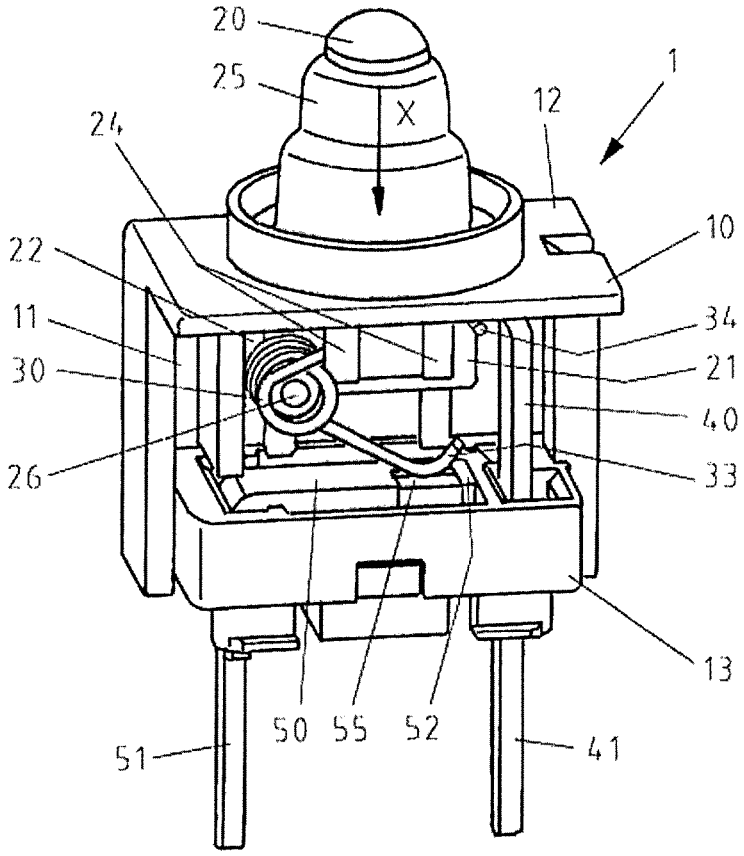
FIG. 1 shows a switch according to an embodiment of the present disclosure.

The embodiments of the present disclosure are described in detail in conjunction with the drawings, so that technical solutions of the present disclosure and beneficial effects may be clear. It should be understood that the drawings are merely for reference and description, rather than limiting the disclosure. Dimensions in the drawings are merely for clear description, rather than limiting scaling relations.

The electrical switch in accordance with embodiments of the present disclosure has a switch housing 10 which defines a receiving space 11. Preferably, the electrical switch is a micro signal switch. In these exemplary embodiments, the switch housing 10 is divided and comprises a lower base 13 as well as a top part 12 which comprises side walls and a top wall. The top wall of the housing 10 is penetrated by an actuating element 20 in the form of a plunger, which is surrounded by a bellow 25.

FIGS. 1 to 10*b* show a micro signal switch 1 according to an embodiment of the present disclosure. The switch 1 in FIG. 1 acts as a normally open switch. A fixed contact element 40, an active contact element 50 and a spring contact element 30 which are made of electrical conductive material are provided in the receiving space 11. Terminals 41, 51 electrically connected to the fixed and active contact elements 40, 50 respectively protrude downwardly from the switch housing 10. The fixed and active contact elements 40, 50 are simple bending parts which are held by the base 13 of the switch housing 10. Each of the fixed and active contact elements 40, 50 forms a monolithic member with the terminals 41, 51 respectively. Optionally the fixed and active contact elements 40, 50 are separately formed with respect to terminals 41, 51. The spring contact element 30 in the form of a torsion spring acts as a contact bridge between the fixed and active contact elements 40, 50. The spring contact element 30 has a middle spring part and two limb ends 33, 34 extending from both sides of the middle spring part. One of the limb ends is stationary and the other one is movable.

The middle spring part is seated on a holding pin 26. The holding pin 26 extends transversely to the actuating direction X of the actuating element 20 from a side wall of a guide body 21 which is provided at bottom of the actuating element 20. In this example, the guide body 21 has guide ribs 24 received in grooves of the housing 10 (not shown) and guide the actuating element 20 in a predetermined path, namely in the actuating direction X. In this example, the guide ribs 24 are provided on two opposite sides of the guide body 21. The holding pin 26 protrudes inwardly from a rear side wall of the guide body 21. In this example, the spring contact element 30 is able to move with the actuating element 20 along the actuating direction X.

Figure 2A:
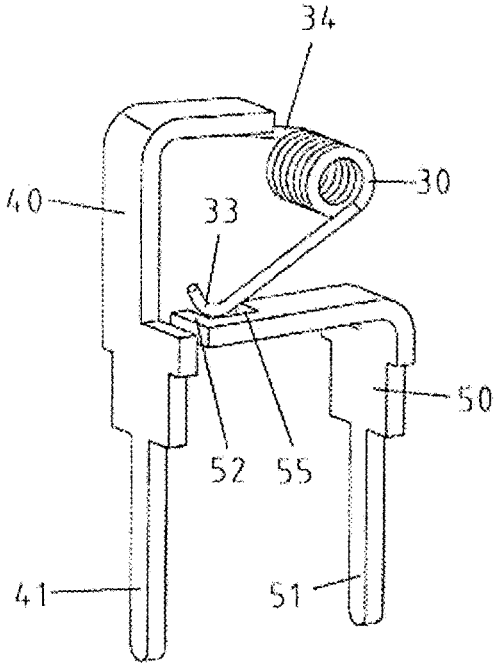
FIG. 2*a* shows the active and fixed contact elements and spring contact element of the switch in FIG. 1, where the actuating element is in the rest position.
Figure 2B:
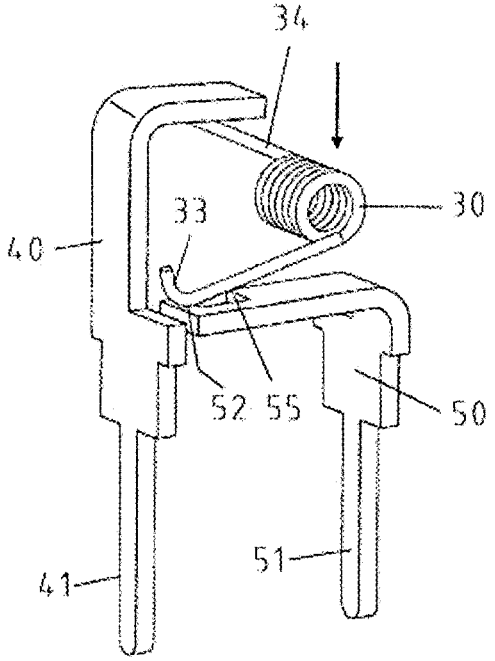
FIG. 2*b* shows the active and fixed contact elements and spring contact element of the switch in FIG. 1, where the actuating element is in the actuated position.

Referred to FIGS. 2*a* and 2*b*, the limb end 34 of the spring contact element 30 is stationary and electrically connected to the contact element 40. The limb end 33 is movable. The limb end 33 is placed on a non-conductive insulation surface 55 in the case the actuating element 20 is in the rest position. The limb end 33 is pushed onto a contact surface 52 of the active contact element 50 by the actuation of the actuating element 20. The movement of the actuating element 20 together with the spring contact element 30 in the actuating direction X causes the limb end 34 to move transversely to the actuating direction X from the insulation surface 55 onto the contact surface 52, thereby making contact with the active contact element 50. After the actuation, the actuating element 20 moves back to the rest position by the spring force of the spring contact element 30, under the assistance of the bellow 25.

Figure 3A:
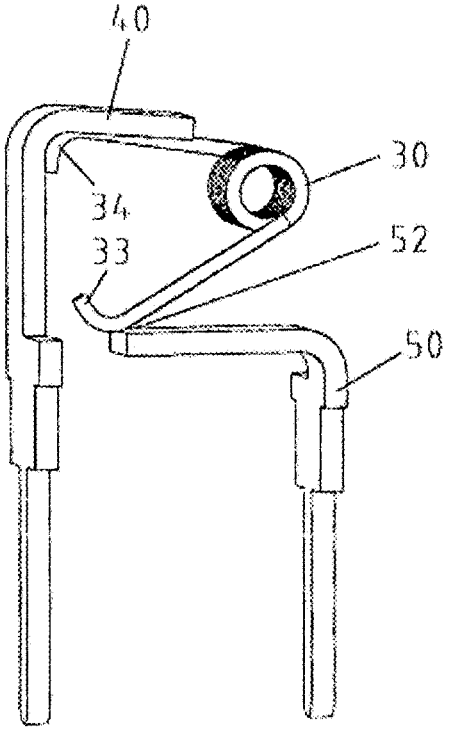
FIG. 3*a* shows the active and fixed contact elements and spring contact element of the switch according to another embodiment of the present disclosure, where the actuating element is in the rest position.
Figure 3B:
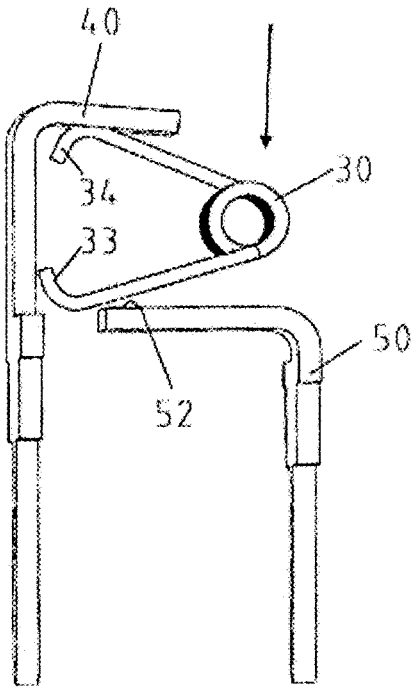
FIG. 3*b* shows the active and fixed contact elements and spring contact element of the switch in FIG. 3*a*, where the actuating element is in the actuated position.

The switch 1 of FIG. 1 can alternatively be configured as a normally closed switch in a case that a modified contact element 50 is assembled. The arrangement of the fixed and active contact elements 40, 50 and the spring contact element 30 for a switch is shown in FIGS. 3*a* and 3*b*. FIG. 3*a* shows the arrangement of the fixed and active contact elements 40, 50 and the spring contact element 30 in the rest position of the actuating element 20. Similar to the switch 1 in FIG. 1, the limb end 34 of the spring contact element 30 in this example is also stationary and electrically connected to the fixed contact element 40. In the case that the actuating element 20 is in the rest position, the limb end 33 is in contact with the active contact element 50 and applies pressure onto the contact surface 52, which ensures reliable contact between the limb end 33 and the contact surface 52. When the actuating element 20 is actuated in the actuating direction X, the spring contact element 30 also moves downwardly, thereby pushing the limb end 33 to move transversely to the actuating direction so as to leave the contact surface 52 of the contact element 50. The determination of configuring the switch 1 as a normally open switch or a normally closed switch may be made when assembling the switch by selecting the corresponding contact element 50.

Figure 4A:
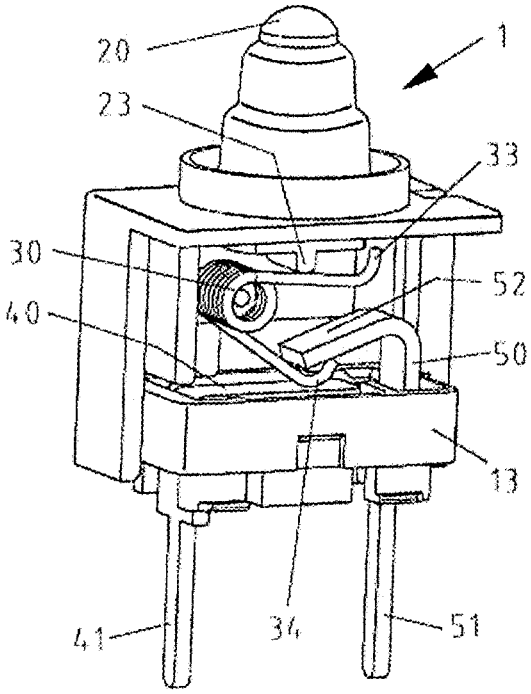
FIG. 4*a* shows a switch according to another embodiment of the present disclosure, where the actuating element in the rest position.
Figure 4B:
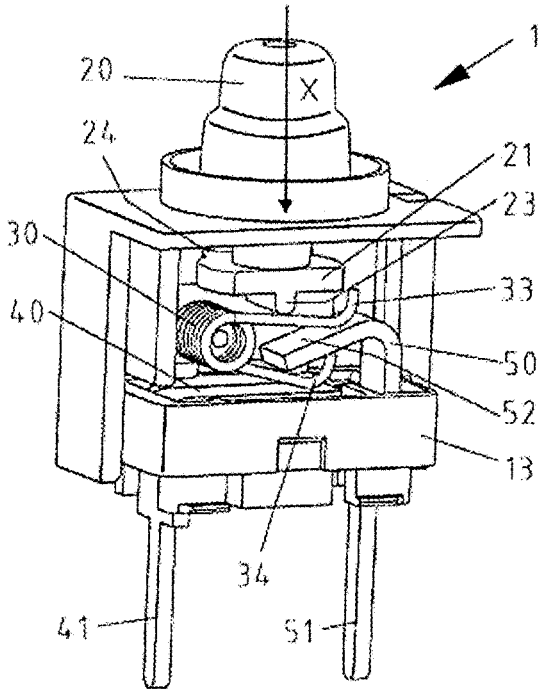
FIG. 4*b* shows the switch in FIG. 4*a*, where the actuating member is in the actuated position.

FIGS. 4*a* and 4*b* show another example of the switch 1. In this example, the fixed contact element 40 is electrically connected to the downwardly extended stationary limb end 34. The active contact element 50 cooperates with the movable limb end 33 which is extended upwardly when the actuating element 20 is in the rest position and presses against a pressing rib 23 of the guide body 21. The fixed and active contact elements 40, 50 are arranged in different planes next to one another in the base 13 of the switch housing 10. FIG. 4*a* shows the rest position of the actuating element 20. The movable limb end 33 of the spring contact element 30 is spaced from the contact surface 52 of the active contact element 50. By actuating the actuating element 20 in the actuating direction X, as shown in FIG. 4*b*, the limb end 33 reaches to a position making contact with the contact surface 52 of the active contact element 50. During the actuation, the pressing rib 23 presses down the limb end 33 of the spring contact element 30 against the spring force. The actuating element 20 is guided via the guide ribs 24 on the guide body 21 and the guide grooves in the housing 10. Only a rear-side guide rib 24 can be seen in FIG. 4*b*. A front-side guide rib opposite to the rear-side guide rib may be provided on the guide body 21.

Figure 5A:
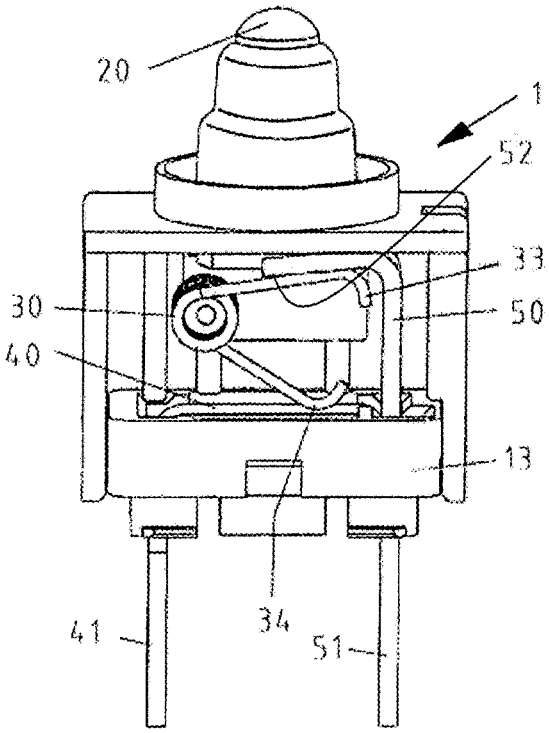
FIG. 5*a* shows a switch according to another embodiment of the present disclosure, where the actuating element in the rest position.
Figure 5B:
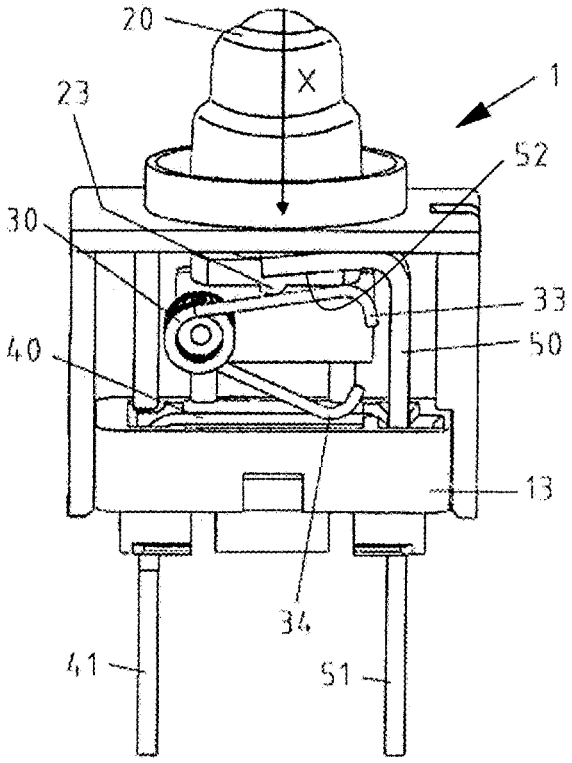
FIG. 5*b* shows the switch in FIG. 5*a*, where the actuating member is in the actuated position.
Figure 6A:
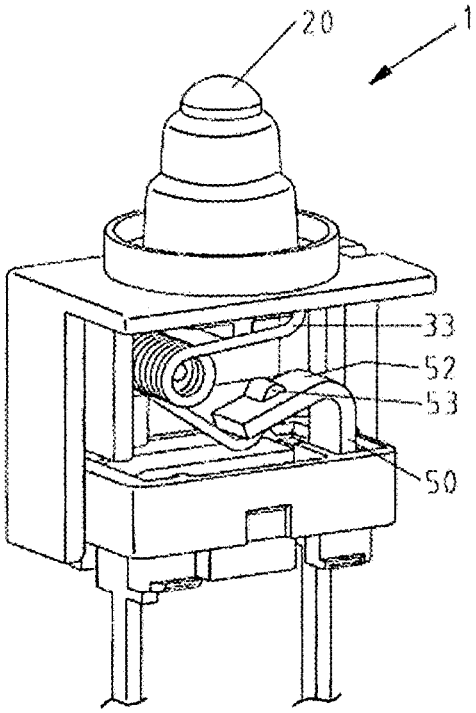
FIG. 6*a* shows a switch according to another embodiment of the present disclosure, where the actuating element in the rest position.
Figure 6B:
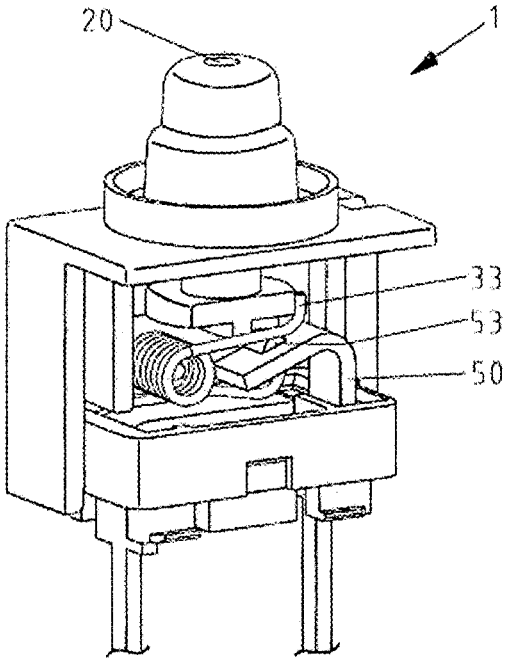
FIG. 6*b* shows the switch in FIG. 6*a*, where the actuating member is in the actuated position.
Figure 7A:
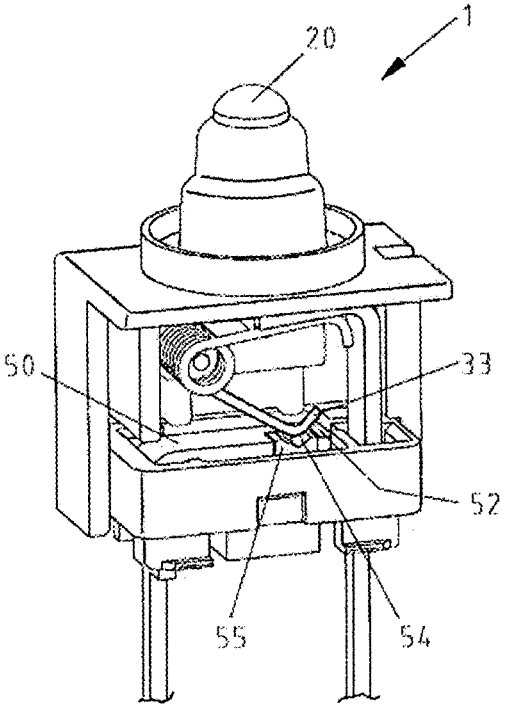
FIG. 7*a* shows a switch according to another embodiment of the present disclosure, where the actuating element in the rest position.
Figure 7B:
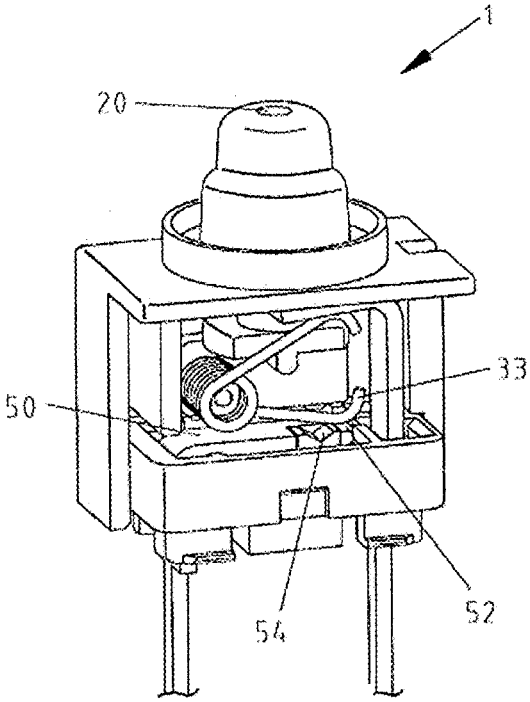
FIG. 7*b* shows the switch in FIG. 7*a*, where the actuating member is in the actuated position.

The switch 1 shown in FIGS. 4*a* and 4*b* is used as a normally open switch. Alternatively, the switch 1 can be configured as a normally closed switch by assembling another kind of active contact element 50. Referring to FIGS. 5*a* and 5*b*, the switch 1 has a spring contact element 30 having the lower limb end 34 which is electrically connected to the fixed contact element 40. In this example, the movable limb end 33 rests against the bottom surface 52 of the bent active contact element 50 in the case the actuating element 20 is in the rest position. Due to the spring force of the spring contact element 30, the limb end 33 applies sufficient contact pressure on the contact surface 52 so that a reliable contact is established. When the actuating element 20 is pressed in the actuating direction X, the spring contact element 30 moves together with the actuating element 20, also, the limb end 33 is simultaneously pressed away from the contact surface 52 of the active contact element 50 by the press rib 23.

If two active contact elements 50 are used in the switch 1 shown in FIGS. 4*a* and 5*a*, a change-over switch can be implemented.

Figure 8A:
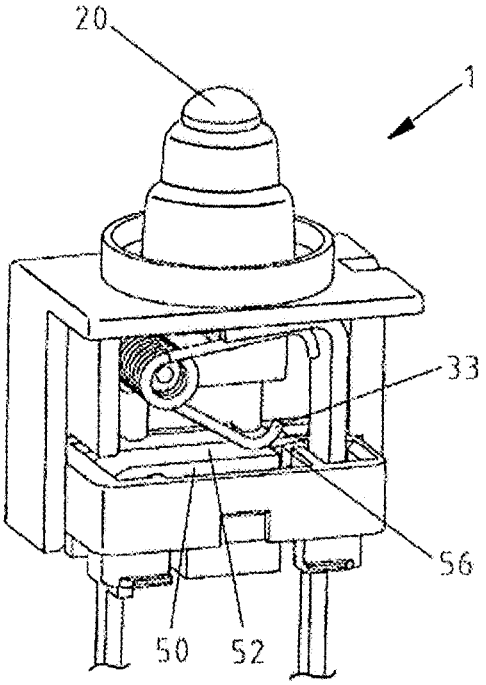
FIG. 8*a* shows a switch according to another embodiment of the present disclosure, where the actuating element in the rest position.
Figure 8B:
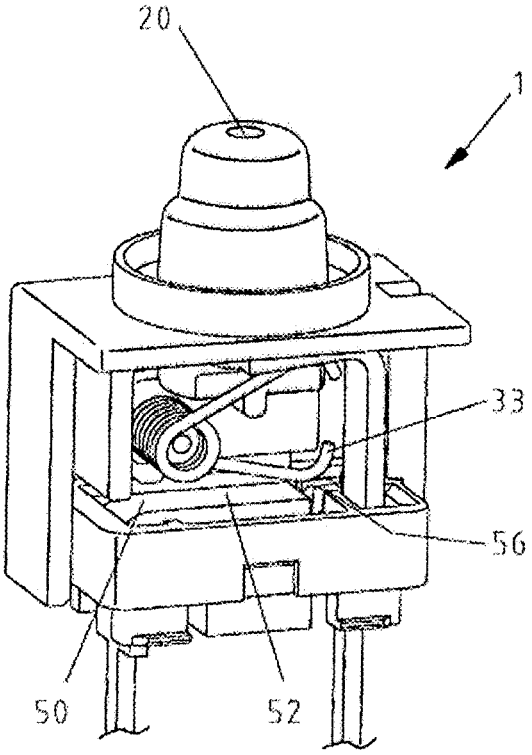
FIG. 8*b* shows the switch in FIG. 8*a*, where the actuating member is in the actuated position.

In the switches shown in FIGS. 6*a* to 8*b*, haptic structure in the form of a projection 53, a depression 54 or a cutout 56 is provided on the active contact element 50. The haptic structure causes the switching process of the switch 1 can be felt when the plunger 20 is actuated. The switches 1 in FIGS. 6*a*, 6*b*, 7*a* and 7*b* are normally open switches. Users can get haptic feedback when the limb end 33 passes the projection 53 in FIGS. 6*a* and 6*b*, or the depression 54 before reaching the contact surface 52 in FIGS. 7*a* and 7*b*. The switch in FIGS. 8*a* and 8*b* is a normally closed switch. The user can feel the switching process when the limb end 33 passes the cutout 56 after leaving the contact surface 52 of the contact element 50.

Structure of the switch 1 in above embodiments is simple as the switch can be made of a few components. A torsion spring is used as the spring contact element 30. It is particularly advantageous that the switch may be configured as a normally open switch, a normally closed switch or a change-over switch simply by assembling a corresponding active contact element when the switch 1 is assembled.

Figure 9A:
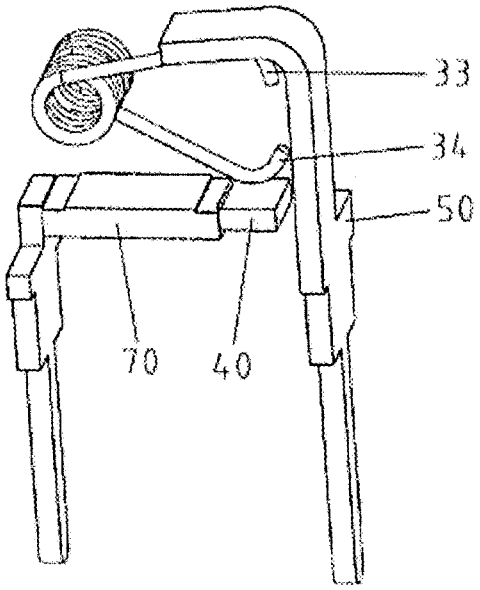
FIG. 9*a* partly shows a normally closed switch according to another embodiment of the present disclosure, in which a resistor is incorporated.
Figure 9B:
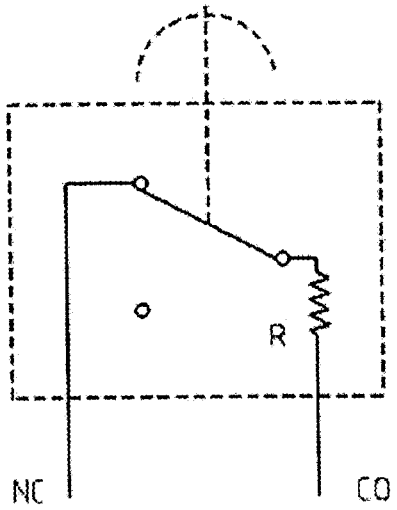
FIG. 9*b* is a circuit diagram of the switch in FIG. 9*a;*
Figure 10A:
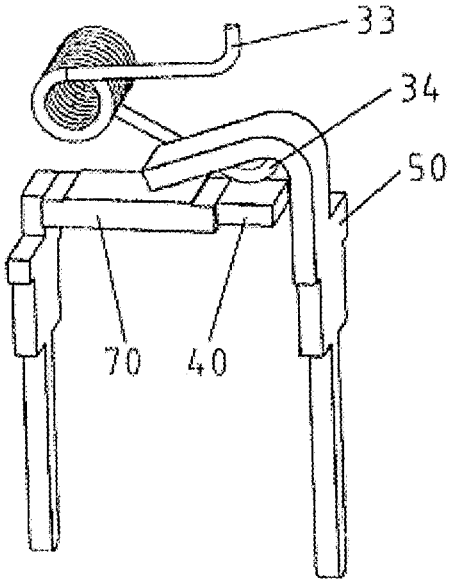
FIG. 10*a* partly shows a normally open switch according to another embodiment of the present disclosure, in which a resistor is incorporated.
Figure 10B:
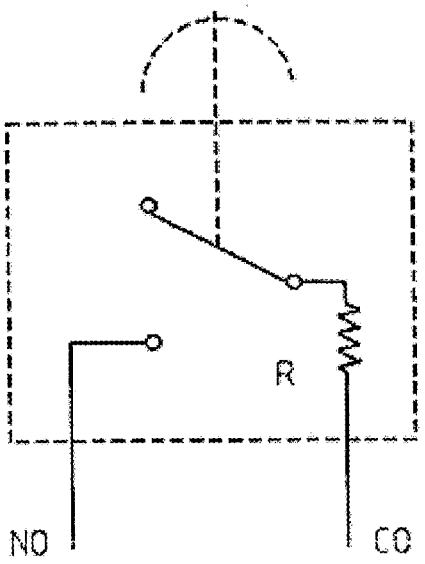
FIG. 10*b* is a circuit diagram of the switch in FIG. 10*a;*
Figure 11:
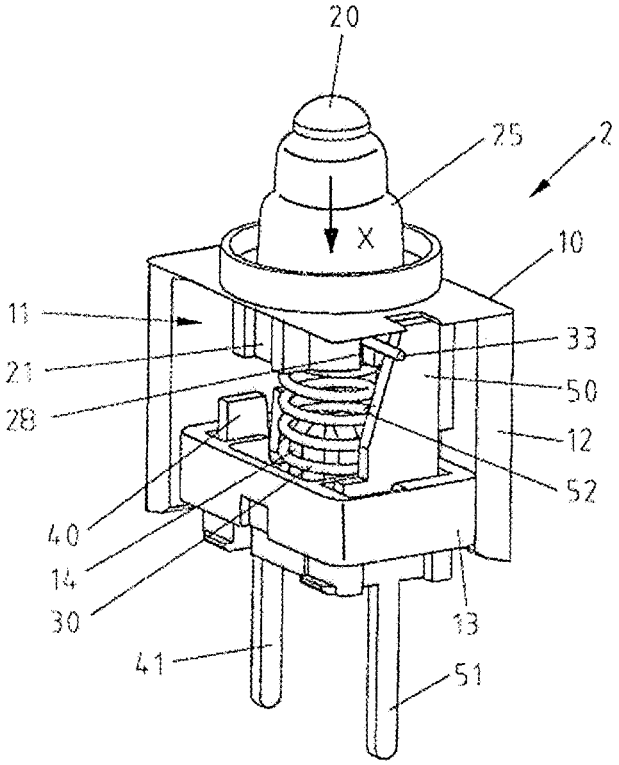
FIG. 11 shows a switch according to another embodiment of the present disclosure, in which two side walls of the switch housing are not shown.

FIGS. 9*a* and 10*a* show another example of switch 1. The switch 1 in FIG. 9*a* is a normally closed switch similar to the switch 1 in FIG. 5*a*. The contact between the limb end 33 of the spring contact element 30 and the active contact element 50 is broken by the movement of the actuating element 20. In addition, a series-connected resistor 70 is provided in the circuit, as can be seen in FIG. 9*b*. The resistor 70, e.g. a surface mounted device (SMD) resistor, is connected to the fixed contact element 40, for example via a soldered connection, via a welded connection preferably by means of laser, or via a clamping connection. By measuring the circuit, in particular by measuring the resistance, it can be determined whether the contact between the limb end 33 and the active contact element 50 is established or not. If there is no contact, the measured resistance will be a maximum value. The externally measurable resistance values can be used for a diagnosis and, for example, integrated into a software query. FIG. 10*a* shows a normally open switch 1 having a resistor 70. The circuit diagram of the switch 1 is shown in FIG. 10*b*. The circuit diagram shows that there is no switching contact yet and the resistance is infinite. If a switching contact is established, which causes the circuit to be closed, a resistance value corresponding to the resistor 70 can be measured. Similarly, the resistor 70 is a SMD resistor connected in series to the fixed contact element 40. The use of SMD resistors allows a compact design. It should be understandable that the series-connected resistor 70 may be alternatively provided on the active contact element 50.

Figure 12:
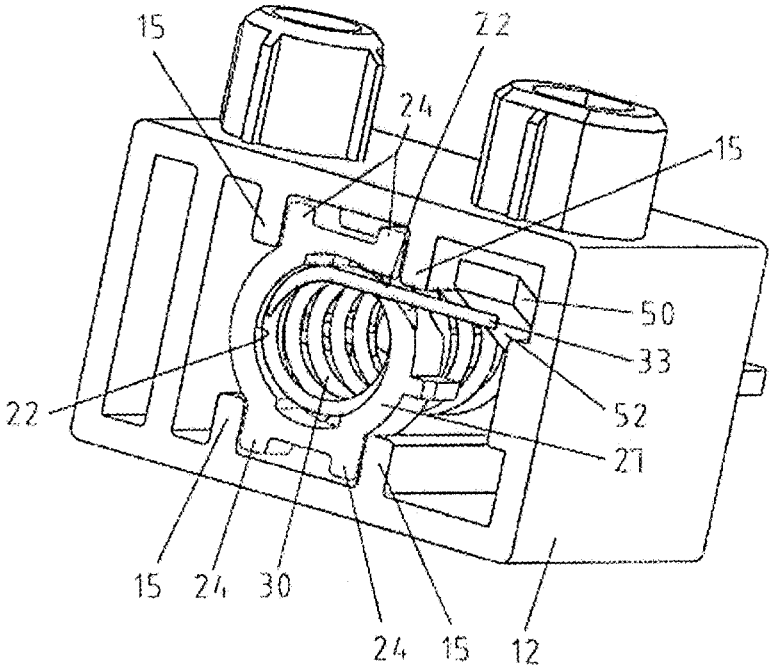
FIG. 12 is a cross-sectional view of the switch in FIG. 11.
Figure 13:
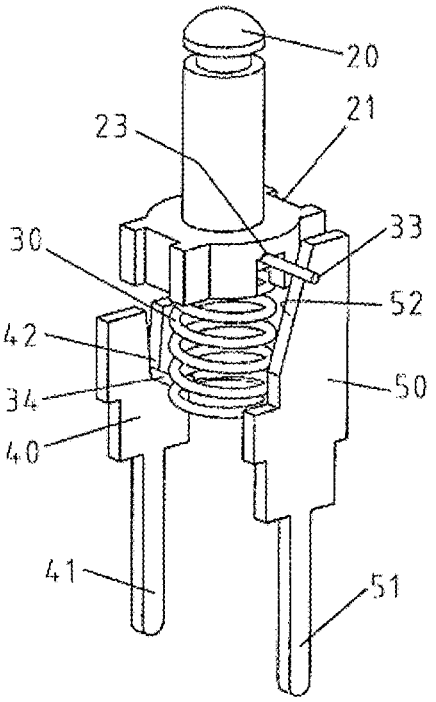
FIG. 13 shows the switch of FIG. 11, in which the switch housing is not shown.
Figure 14:
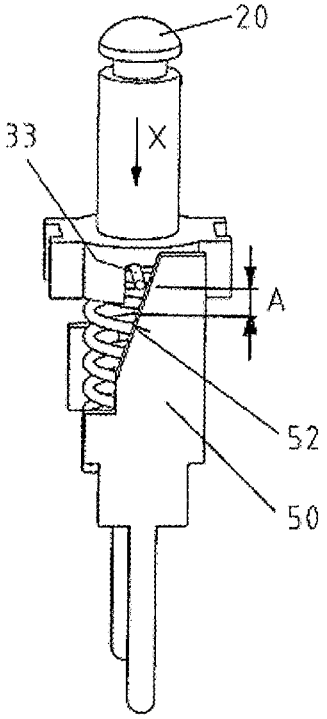
FIG. 14 is a side view of the switch in FIG. 13.

FIGS. 11 to 20*b* show a micro signal switch 2 according to another embodiment of the present disclosure. The switch 2 acts as a normally open switch. A fixed contact element 40, an active contact element 50 and a spring contact element 30 which are made of electrical conductive material are provided in the receiving space 11. Terminals 41, 51 electrically connected to the fixed and active contact elements 40, 50 respectively protrude downwardly from the switch housing 10. The fixed and active contact elements 40, 50 are simple bending parts which are held by the base 13 of the switch housing 10. Each of the fixed and active contact elements 40, 50 forms a monolithic member with the corresponding terminal 41, 51 respectively. Optionally the fixed and active contact elements 40, 50 are separately formed with respect to the terminals 41, 51. The spring contact element 30 in the form of a press spring acts as a contact bridge between the fixed and active contact elements 40, 50. The spring contact element 30 has a middle spring part and two limb ends 33, 34 protruding from two ends of the middle spring part. One of the limb ends is stationary and the other one is movable. Referring to FIG. 13, the spring contact element 30 has a lower limb end 34 which is fixedly connected to the fixed contact element 40 via a clamping connection or a soldered connection, for example. The upper part of the spring contact element 30, especially the upper limb end 33, is held in position by a receiving body 27 provided at bottom of the actuating element 20. As shown in FIG. 12, the upper part of the spring contact element 30 is received in a receiving channel 22 of the receiving body 27. The receiving channel 22 extends in the actuating direction X. The upper limb end 33 protrudes laterally through a slot 28 in the receiving body 27 and is spaced from the contact surface 52 of the active contact element 50 by a contact distance A, as shown in FIG. 14. Preferably, the upper limb end 33 of the spring contact element 30 is pre-positioned in the actuating element 20, moves along a predetermined path, which is caused by a guided movement of the actuating element 20 in the actuating direction X, and reaches a predetermined contact position after moving a short distance. From the rest position to the actuated position, the actuating element 20 has a longer moving distance compared to the contact distance A. In the later stage of the movement, the upper limb end 33 of the spring contact element 30 experiences an overrun and slides on the contact surface 52 of the active contact element 50. Thus, the upper limb end 33 is twisted. To ensure reliable contact and sufficient contact pressure of the upper limb end 33 on the active contact member, the upper limb end 33 is pre-positioned in the receiving body 27 of the actuating element 20 under biasing force. In this example, the receiving body 27 has the slot 28 forming in the side wall thereof. The limb end 33 passes through the slot 28 and is positioned by the receiving body 27 of the actuating member 20 in a twisted manner such that sufficient biasing force can be obtained, which ensures reliable contact between the limb end 33 and the contact surface 52 of the active contact element 50 and sufficient contact pressure can be applied onto the contact surface 52. After the actuation, the actuating element 20 is moved back to the rest position under the spring force of the spring contact element 30 and assistance of the bellow 25.

When the switch 2 is actuated, the upper limb end 33 of the spring contact element 30 passes over the contact distance A along a given path. For this purpose, a guiding structure for the actuating element 20 is provided in the switch housing 10. In FIG. 2, the guiding structure includes two pairs of guide ribs 24 on the outer surface of the receiving body 27. Each pair of guide ribs 24 are engaged into a groove in the switch housing 10. The groove may be formed by two guide strips 15 extending in the actuating direction X. Via the cooperation of the guide ribs 24 on the receiving body 27 of the actuating element 20 and the guide strips 15 of the switch housing 10, the movement of the actuating element 20 in the actuating direction X is predetermined. Thus the moving path of limb end 33 held in the receiving body 27 is also predetermined. In addition, the lower part of the spring contact element 30 is held by a protrusion 14 formed on the base 13 of the switch housing 10. The protrusion 14 snaps into the spring contact element 30 from below. Advantageously, the switch 2 with the pressure spring can be formed by a small number of components and the contact distance A between the spring contact element 30 and the active contact element 50 is small. Due to the overrun and the sliding of the upper limb end 33 on the contact surface 52 which is inclined with respect to the actuating direction X, reliable contact can be assured.

Figure 15A:
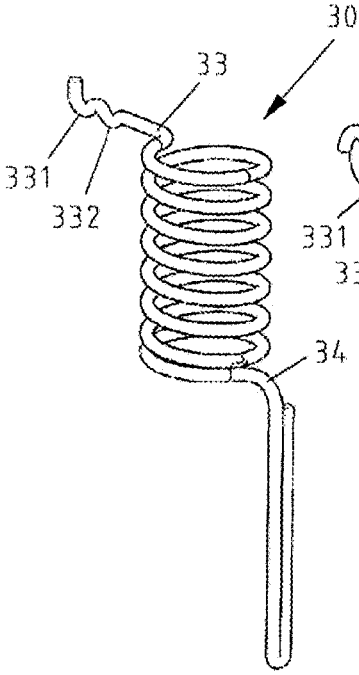
FIGS. 15*a* to 15*c* shows several other spring contact elements that are suitable for the switch in FIG. 11.
Figure 15B:
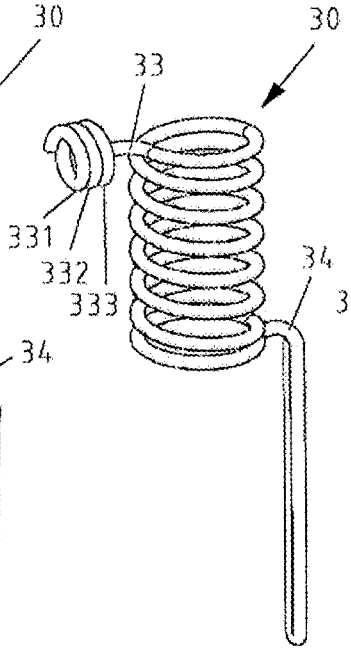
Figure 15C:
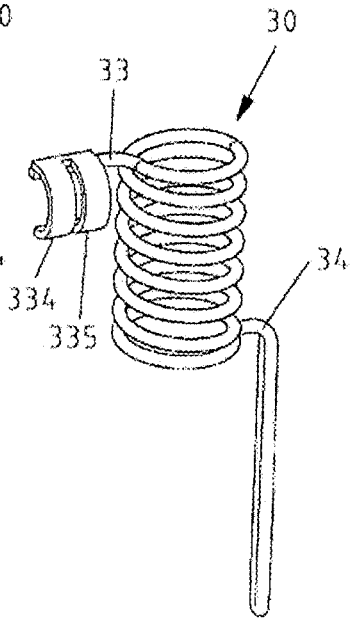

FIGS. 15*a* to 15*c* illustrate some other examples of the spring contact element 30. In FIG. 15*a* the upper limb 33 has two contact points 331, 332. In FIG. 16*a* the upper limb 33 has three contact points 331, 332, 333. The contact points may be formed by bending and establish a reliable contact with the active contact element 50. In FIG. 15*c*, a contact plate is welded to the upper limb end 33 of the spring contact element 30 to form two or more contact surfaces 334, 335.

The lower limb end 34 may be fixedly connected to the fixed contact element 40, as shown in FIG. 13. Alternatively, the limb end 34 may be integrally formed with the fixed contact member 40, as shown in FIGS. 5*a*, 5*b* and 5*c*. In this case, the lower limb end 34 extends out of the switch housing 10 and the lower end of the lower limb 34 forms the terminal 41.

Figure 16:
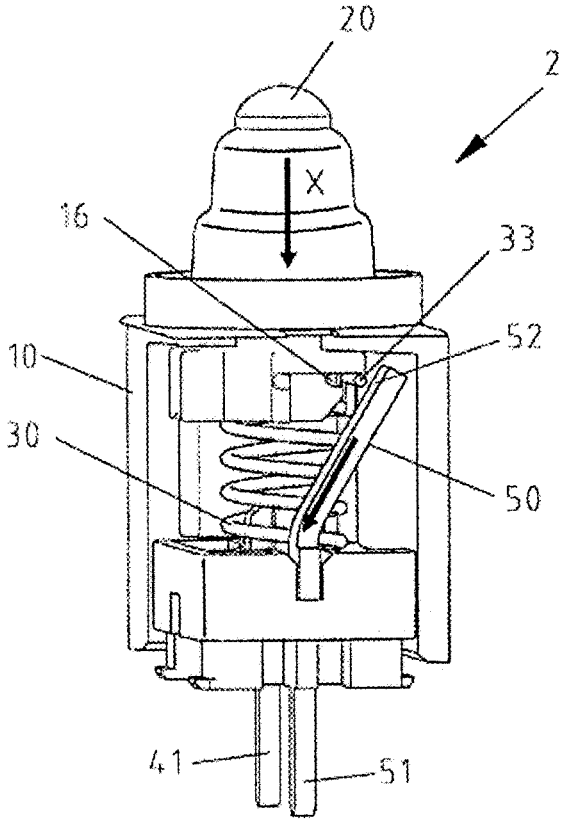
FIG. 16 shows a switch according to another embodiment of the present disclosure, in which two side walls of the switch housing are not shown.

FIG. 16 shows another example of the switch 2. Compared to the switch 2 in FIG. 11, the active contact element 50 of this example is a strip. The contact surface 52 of the active contact element 50 is inclined with respect to the actuating direction X of the plunger 20. The upper limb end 33 of the spring contact element 30 slides along the contact surface 52. The switch 2 of this example is also a normally open switch. Upon actuation of the actuating element 20, the contact between the fixed and active contact elements 40, 50 is established by the spring contact element 30.

Figure 17A:
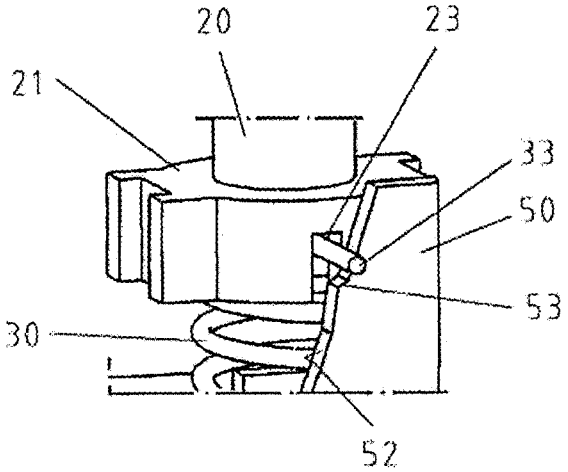
FIG. 17*a* is a partial view of a switch in accordance with another embodiment of the present disclosure, in which haptic sensing structure is shown.
Figure 17B:
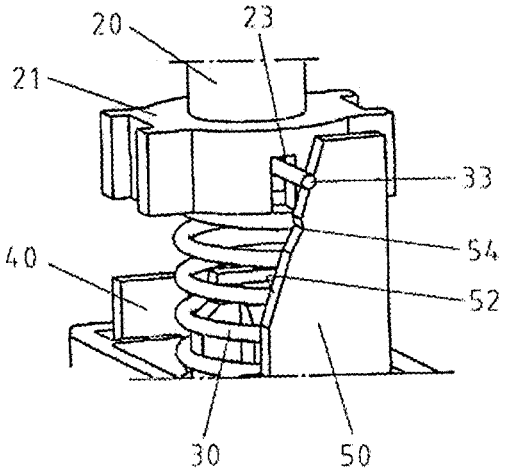
FIG. 17*b* is a partial view of a switch in accordance with another embodiment of the present disclosure, in which haptic sensing structure is shown.

In the switches shown in FIGS. 17*a* and 17*b*, haptic structure in the form of a projection 53, a depression 54 or a cutout 56 is provided on the active contact element 50 or the switching 10. The haptic structure causes the switching process of the switch 2 can be felt when the plunger 20 is actuated. The switches 2 in FIGS. 17*a* and 17*b* are normally open switches. Users can get haptic feedback when the limb end 33 passes the projection 53 in FIG. 17*a*, or the depression 54 before reaching the contact surface 52 in FIG. 17*b*.

Optionally, the haptic structure may be provided on the switch housing 10, for example in the form of a projection 16 as shown in FIG. 16. Upon actuation of the actuating element 20, the upper limb end 33 jumps from the projection 16 of the housing 10, which is tangible to the user.

Figure 18:
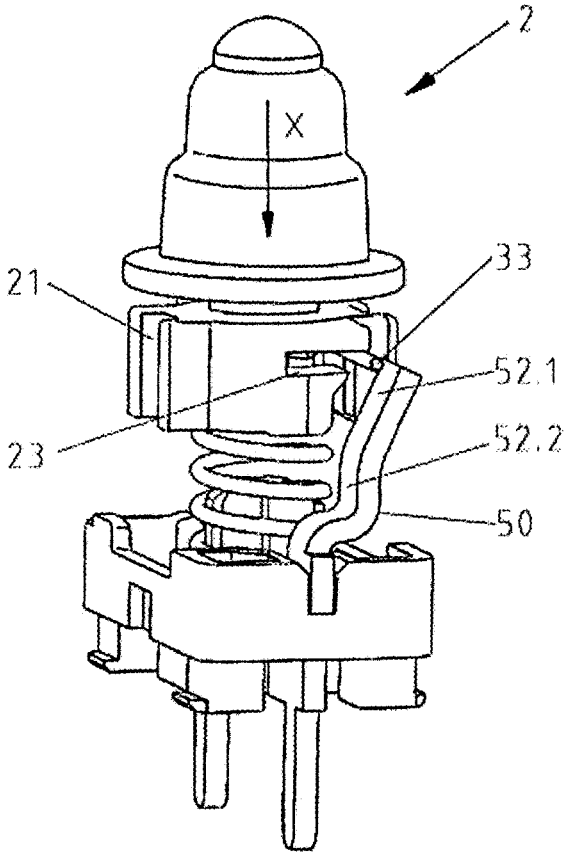
FIG. 18 is a perspective view of a micro signal switch according to another embodiment of the present application, in which the housing is not shown.
Figure 19:
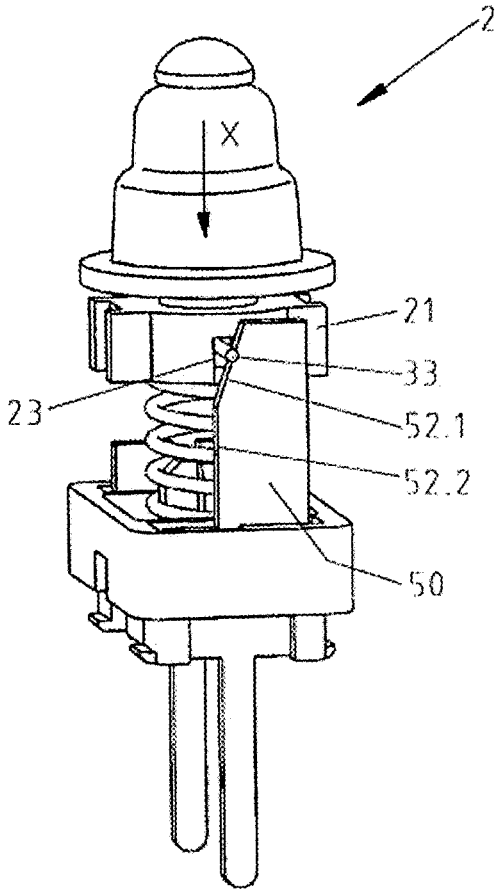
FIG. 19 is a side perspective view of a micro signal switch of another embodiment of the present application in which the switch housing is not shown.

As described above, the upper limb end 33 of the spring contact element 30 is pre-positioned by the receiving body 27, twisted and held under tension against the spring force. When the actuating element 20 is actuated in the actuating direction X, the upper limb end 33 is further twisted, which means that the spring contact element 30 is subject to a bending load and a torsional load each time the actuating element 20 is actuated. By specially configuring the contact surface 52 of the contact element 50, the load on the spring contact element 30 can be reduced. In FIGS. 18 and 19, the contact surface 52 is divided into a first contact area 52.1 inclined with respect to the actuating direction X and a second contact area 52.2 extending in the actuating direction X. When actuated, the limb end 33 slides on the inclined area 52.1 first, which makes the spring contact element 30 further twisted. Then the limb end 33 slides on the second contact area 52.2, without increasing the load on the spring contact element 30. By the configuration, the spring contact element 30 has a longer service life.

Figure 20A:
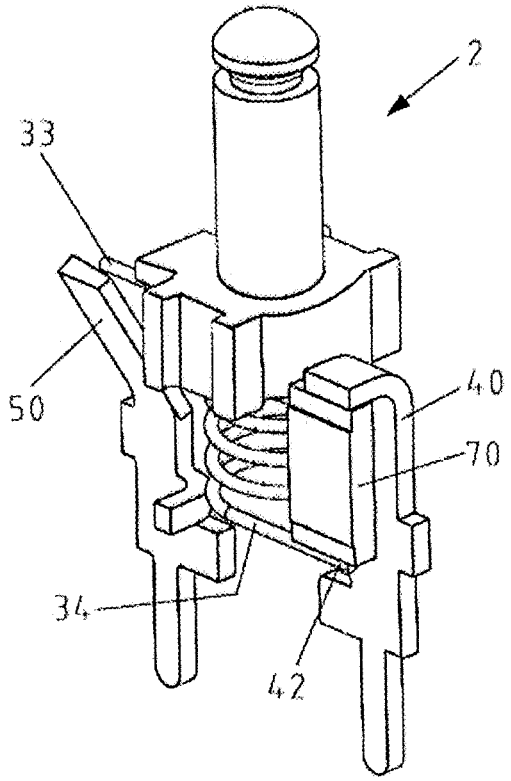
FIG. 20*a* partly shows a switch according to another embodiment of the present disclosure, in which a resistor is incorporated and the switch housing is not shown.
Figure 20B:
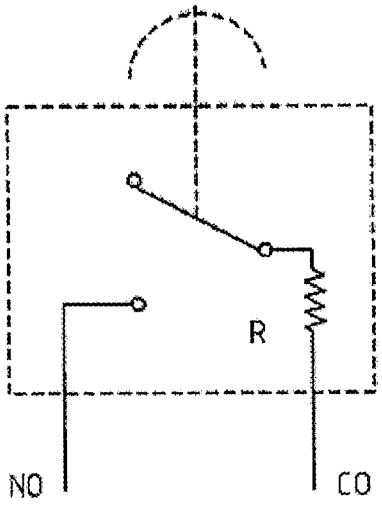
FIG. 20*b* is a circuit diagram of the switch in FIG. 20*a;*
Figure 21:
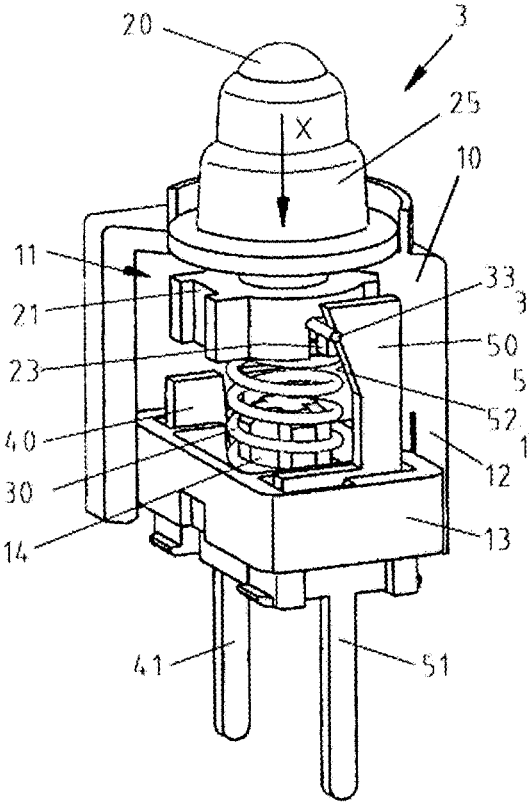
FIG. 21 shows a switch according to another embodiment of the present disclosure, in which two side walls of the switch housing are not shown.

FIG. 20*a* show another example of the switch 2. The switch 2 is a normally open switch similar to the switch 2 in FIG. 16. The contact between the limb end 33 of the spring contact element 30 and the active contact element 50 is established by the movement of the actuating element 20. In addition, a series-connected resistor 70 is provided in the circuit, as shown in FIG. 20*b*. The resistor 70, preferably a SMD resistor, is connected to the fixed contact element 40, for example via a soldered connection, via a welded connection preferably by means of laser, or via a clamping connection. The limb end 34 is engaged into a slot 42 between the resistor 70 and the fixed contact element 40. By measuring the circuit, in particular by measuring the resistance, it can be determined whether the contact between the limb end 33 and the active contact element 50 is established or not. If there is no contact, the measured resistance will be a maximum value. The externally measurable resistance values can be used for a diagnosis and, for example, integrated into a software query. The circuit in FIG. 20*b* shows that there is no switching contact yet and the resistance is infinite. If a switching contact is established, which causes the circuit to be closed, a resistance value corresponding to the resistor 70 can be measured. The use of SMD resistors allows a compact design. It should be understandable that the series-connected resistor 70 may be alternatively provided on the active contact element 50.

Figure 22:
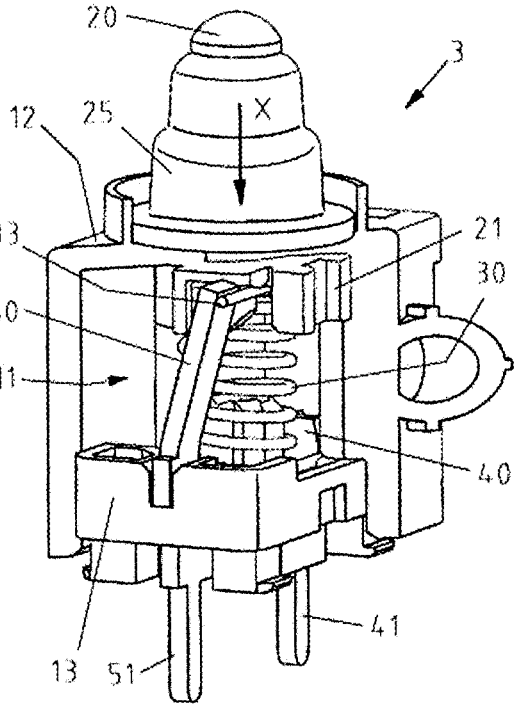
FIG. 22 shows a switch according to another embodiment of the present disclosure, in which two side walls of the switch housing are not shown.
Figure 23:
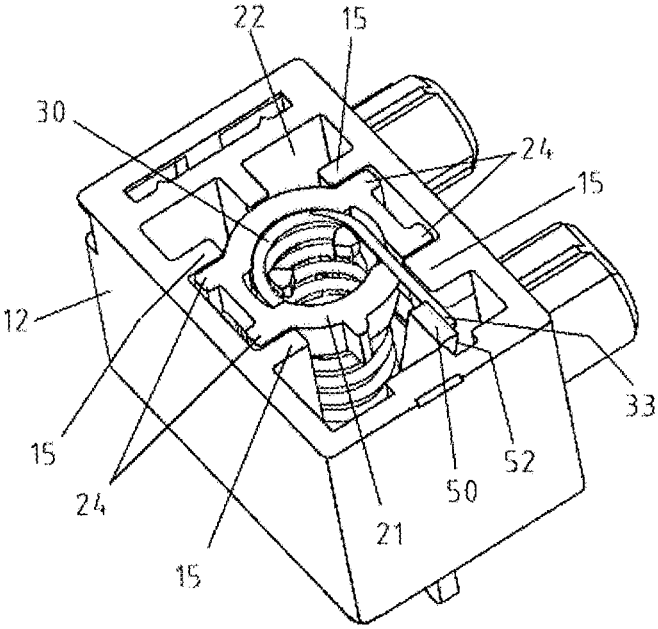
FIG. 23 is a cross-sectional view of the switch in FIG. 22, in which the switching housing is shown.

FIGS. 21 to 28*b* show a micro signal switch 3 according to another embodiment of the present disclosure. The switch 3 acts as a normally closed switch. A fixed contact element 40, an active contact element 50 and a spring contact element 30 which are made of electrical conductive material are provided in the receiving space 11. Terminals 41, 51 electrically connected to the fixed and active contact elements 40, 50 respectively protrude downwardly from the switch housing 10. The fixed and active contact elements 40, 50 are simple stamping members which are held by the base 13 of the switch housing 10. Each of the fixed and active contact elements 40, 50 forms a monolithic member with the corresponding terminal 41, 51 respectively. Optionally the fixed and active contact elements 40, 50 are separately formed with respect to terminals 41, 51. The spring contact element 30 in the form of a press spring acts as a contact bridge between the fixed and active contact elements 40, 50. The spring contact element 30 has a middle spring part and two limb ends 33, 34 protruding from two ends of the middle spring part. One of the limb ends is stationary and the other one is movable. Referring to FIG. 23, the spring contact element 30 has a lower limb end 34 which is stationary and connected to the fixed contact element 40 via a clamping connection or a soldered connection, for example. The upper part of the spring contact element 30, especially the upper limb end 33, is held in position by a receiving body 27 provided at bottom of the actuating element 20. The upper part of the spring contact element 30 is received in a receiving channel 22 of the receiving body 27. The receiving channel 22 extends in the actuating direction X. The upper limb end 33 protrudes laterally through a slot 28 in the receiving body 27 through a slot 23 and presses against the inclined contact surface 52 of the active contact element 50 from below.

FIG. 22 shows another example of the switch 3. Compared to the switch 3 in FIG. 11, the active contact element 50 of this example is a strip. The contact surface 52 of the active contact element 50 is inclined with respect to the actuating direction X of the plunger 20. The upper limb end 33 of the spring contact element 30 is in contact with the contact surface 52. The switch 3 of this example is also a normally closed switch. Upon actuation of the actuating element 20, the contact between the fixed and active contact elements 40, 50 is broken.

The upper limb end 33 of the spring contact element 30 is pre-positioned in the actuating element 20, moves along a predetermined path together with a guided movement of the actuating element 20 in the actuating direction X. The contact between the upper limb end 33 and the contact surface 52 is disconnected after the upper limb end 33 moves a short distance. To ensure reliable contact and sufficient contact pressure of the upper limb end 33 on the active contact element, the upper limb end 33 is pre-positioned in the receiving body 27 of the actuating member 20 under biasing. In this example, the receiving body 27 has the slot 28 formed in its side wall. The limb end 33 passes through the slot 28 and is positioned by the receiving body 27 of the actuating member 20 in a twisted manner such that sufficient biasing force can be obtained, which ensures reliable contact between the limb end 33 and the contact surface 52 of the active contact element 50 and sufficient contact pressure can be applied onto the contact surface 52. After the actuation, the actuating element 20 is moved back to the rest position under the spring force of the spring contact element 30 and assistance of the bellow 25.

When the switch 3 is actuated, the upper limb end 33 of the spring contact element 30 is guided along a given path. For this purpose, a guiding structure for the actuating element 20 is provided in the switch housing 10. In FIG. 23, the guiding structure includes two pairs of guide ribs 24 on the outer surface of the receiving body 27. Each pair of guide ribs 24 are engaged into a groove in the switch housing 10. The groove may be formed by two guide strips 15 extending in the actuating direction X. Via the cooperation of the guide ribs 24 on the receiving body 27 of the actuating element 20 and the guide strips 15 of the switch housing 10, the movement of the actuating element 20 in the actuating direction X is predetermined. Thus the moving path of limb end 33 held in the receiving body 27 is also predetermined. In addition, the lower part of the spring contact element 30 is held by a protrusion 14 formed on the base 13 of the switch housing 10. The protrusion 14 snaps into the spring contact element 30 from below.

Figure 25A:
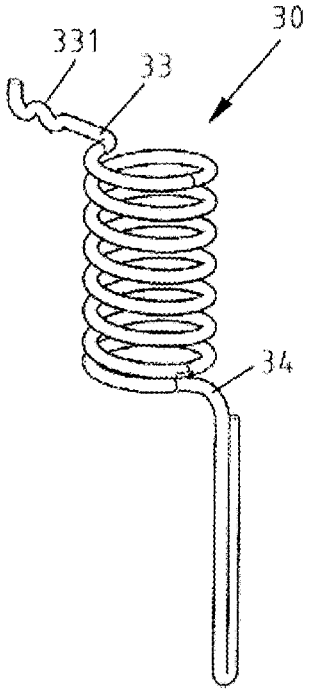
FIGS. 25*a* and 25*b* show two spring contact elements that are suitable for the switch in FIG. 22.
Figure 25B:
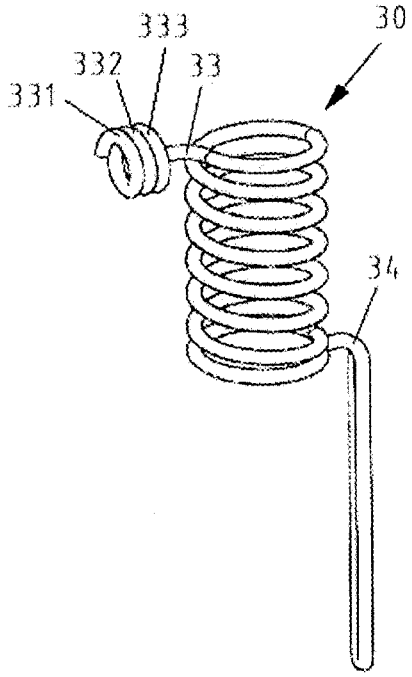

FIGS. 25*a* and 25*b* illustrate some other examples of the spring contact element 30. In FIG. 25*a* the upper limb 33 has a contact point 331. In FIG. 25*b* the upper limb 33 has three contact points 331, 332, 333. The contact points may be formed by bending and establish a reliable contact with the active contact element 50. Optionally, a contact plate may be welded to the upper limb end 33 of the spring contact element 30 to form at least one contact surface.

Figure 24:
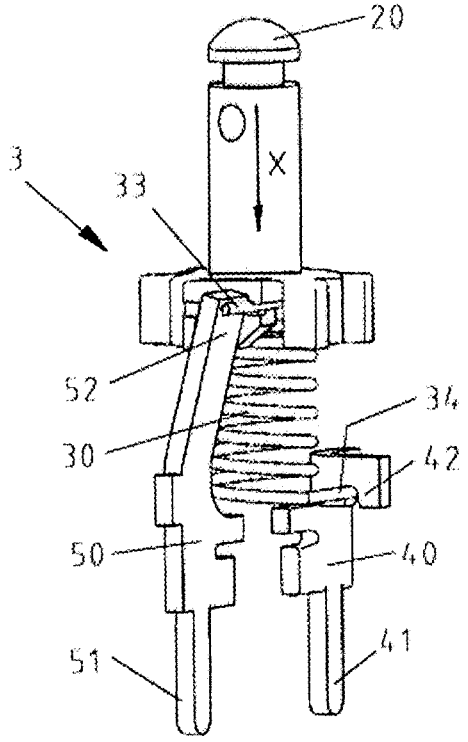
FIG. 24 shows a switch in FIG. 22, in which the switch housing is not shown.

The lower limb end 34 may be fixedly connected to the fixed contact element 40, as shown in FIG. 24. Alternatively, the limb end 34 may be integrally formed with the fixed contact member 40, as shown in FIGS. 15*a* and 15*b*. In this case, the lower limb end 34 extends out of the switch housing 10 and the lower end of the lower limb 34 forms the terminal 41.

Figure 26A:
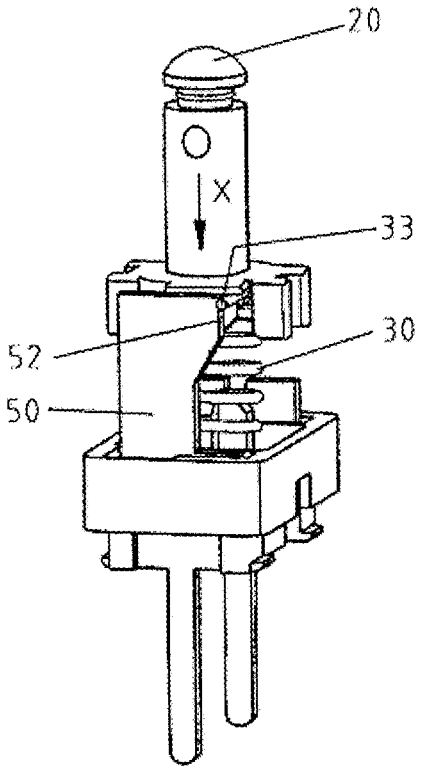
FIGS. 26*a* and 26*b* show two progressive transition switches according to other embodiments of the present disclosure.
Figure 26B:
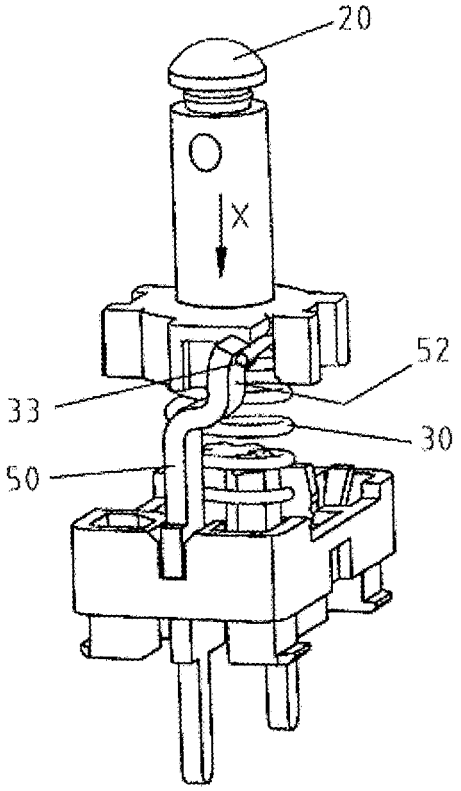

A relatively long actuating path may be provided for the actuating element 20 from the rest position to the actuated position and a creeping switching transition can be realized, as shown in FIGS. 26*a* and 26*b*. In this case, the upper limb end 33 forwardly slides along the contact surface 52 of the active contact element 50 before it moves away from the active contact element 50. The forward slide of the upper limb end 33 on the contact surface 52 is achieved when the direction of the contact surface 52 is properly configured. In this example, the contact surface 52 is parallel to the actuating direction X. During making of the active contact element 50 by stamping the vertically extended contact surface 52 and the inclined surface which defines an obtuse angle with the contact surface 52, as shown in FIG. 26*a*, can be simply formed. In FIG. 26*b*, the active contact element 50 is in the form of a strip and has a vertical contact surface 52 and an inclined surface for disconnecting the contact between the movable limb end 33 and the contact surface 52.

Figure 27A:
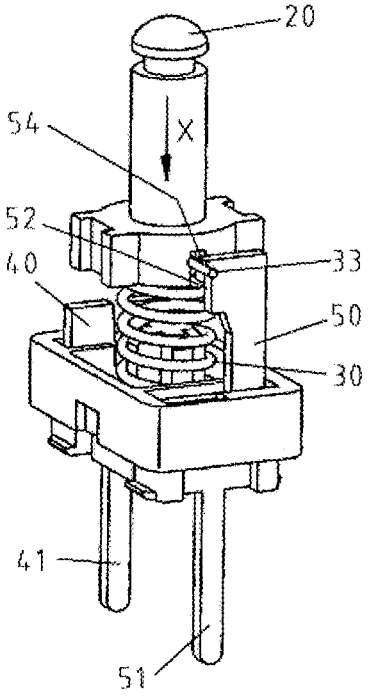
FIGS. 27*a* to 27*c* partially show three switches according to other embodiments of the present disclosure, in which haptic sensing structures are shown.
Figure 27B:
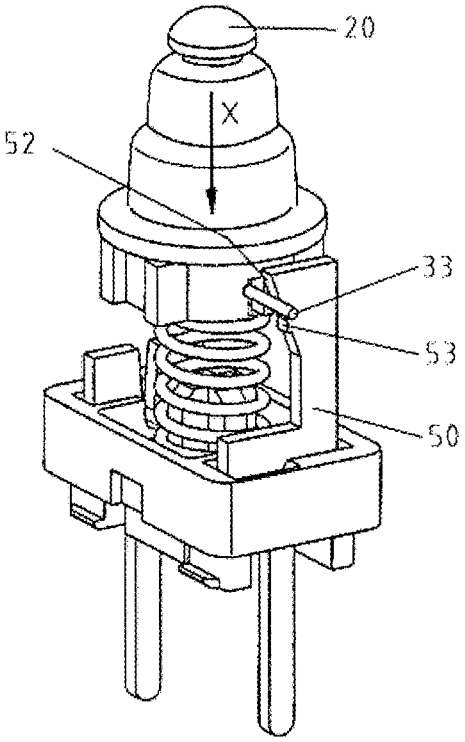
Figure 27C:
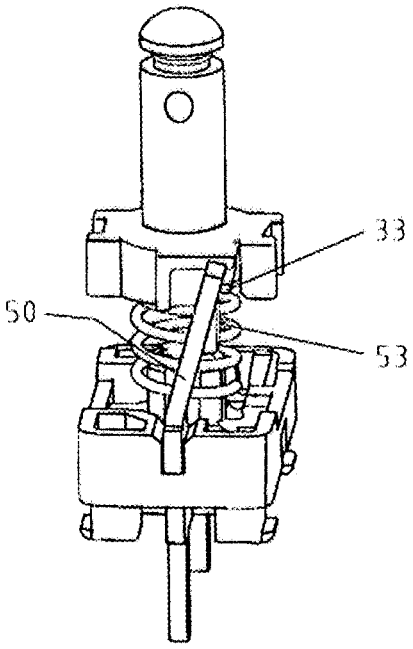

In FIGS. 27*a* and 27*b*, the contact surface 52 is received in the receiving body 27 of the actuating member 20. In the case the actuating member is in the rest position, the limb end 33 rests on and applies sufficient contact pressure to the contact surface 52 under biasing force to ensure reliable contact with the active contact element 20. The limb end 33 is kept in the receiving body 27 under the biasing force. Thus during the movement of the actuating element 20 the limb end 33 does not lift off from the contact surface 52 or leave the contact surface 52 too early due to the spring force. In the switches shown in FIGS. 27*a* and 27*b*, haptic structure in the form of a projection 53 and a depression 54 are provided on the active contact element 50 or the switching housing 10. The haptic structure causes the switching process of the switch 3 can be felt when the plunger 20 is actuated. The switches 3 in FIGS. 27*a* and 27*b* are normally closed switches. Users can get haptic feedback when the limb end 33 passes the depression 54 in FIG. 27*a*, or the projection 53 in FIG. 27*b*, before leaving the contact surface 52. In FIG. 27*c* the active contact element 50 is in the form of a strip and has a projection 53

Figure 28A:
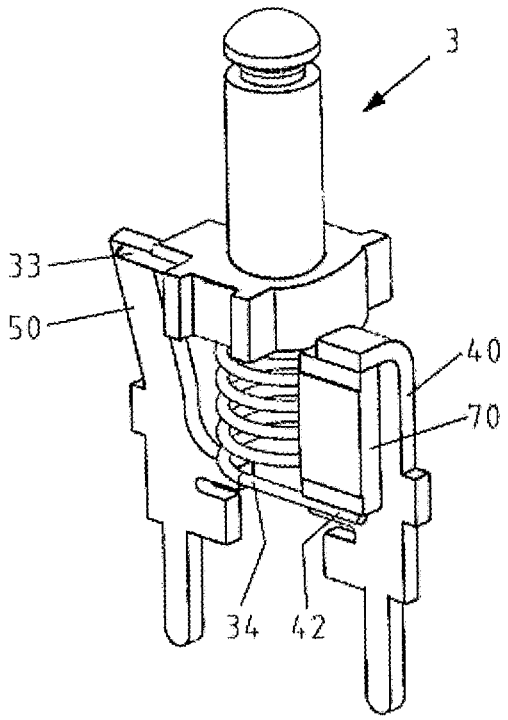
FIG. 28*a* partly shows a switch according to another embodiment of the present disclosure, in which a resistor is incorporated and the switch housing is not shown.
Figure 28B:
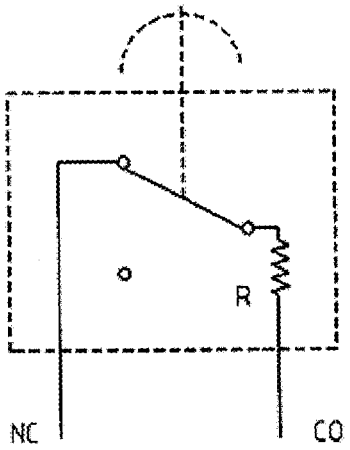
FIG. 28*b* is a circuit diagram of the switch in FIG. 28*a;*

In the example of the normally closed switch 3 in FIG. 28*a*, a resistor 70 is assembled on and electrically connected to the fixed contact element 40. The limb end 34 is engaged into a slot 42 between the resistor 70 and the fixed contact element 40. FIG. 28*b* illustrates the circuit diagram of the switch 3.

Figure 29:
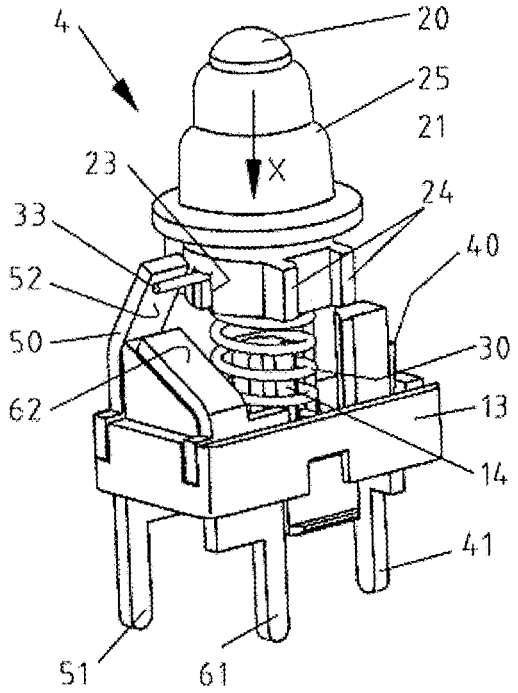
FIG. 29 shows a switch according to another embodiment of the present disclosure, in which the switch housing is not shown.
Figure 30:
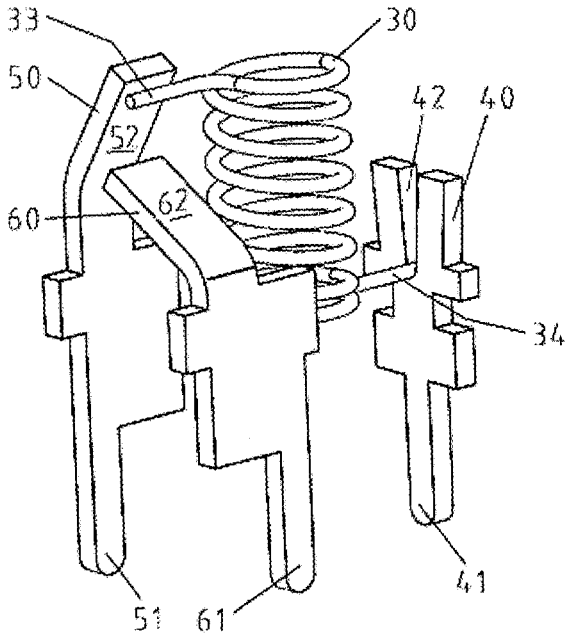
FIG. 30 shows the fixed contact element, the first and second active contact elements and spring contact element of the switch in FIG. 29.
Figure 31:
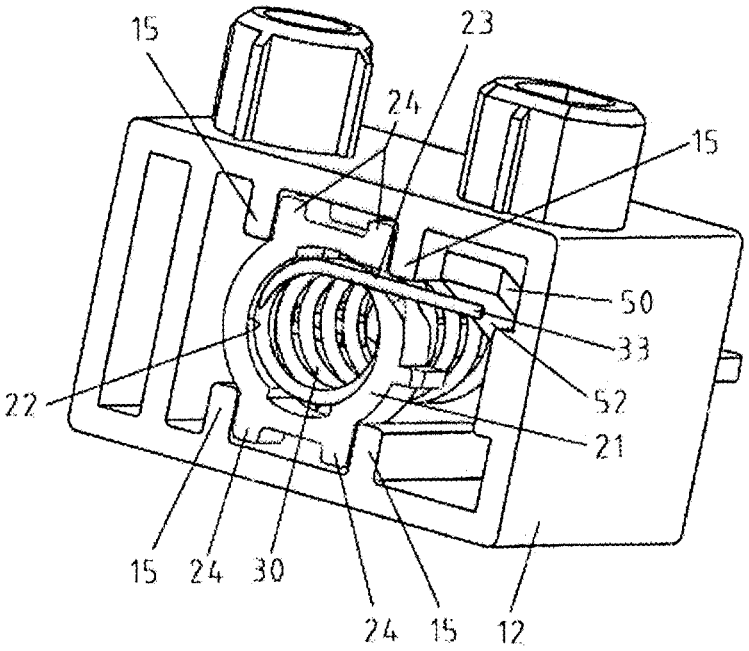
FIG. 31 is a cross-sectional view of the switch in FIG. 29.

FIGS. 29 to 31 illustrate the switch 4 in accordance with another embodiment of the present disclosure. A fixed contact element 40, a first active contact element 50, a second active contact element 60 and a spring contact element 30 which are made of electrical conductive material are provided in the receiving space 11. Terminals 41, 51, 61 electrically connected to the fixed and active contact elements 40, 50, 60 respectively protrude downwardly from the switch housing 10. The fixed and active contact elements 40, 50, 60 are simple stamping members which are held by the base 13 of the switch housing 10. Each of the fixed and active contact elements 40, 50, 60 forms a monolithic member with the corresponding terminal 41, 51 61 respectively. Optionally the fixed and active contact elements 40, 50, 60 are separately formed with respect to the terminals 41, 51, 61. The spring contact element 30 in the form of a press spring acts as a contact bridge between the fixed contact element 40 and the first active contact element 50 or between the fixed contact element 40 and the second active contact element 60. The fixed contact member 40 forms a common contact (CO) with its terminal 41. When the actuating element 20 is in the rest condition, the first active contact element 50 is in contact with the fixed contact element 40 and a normally closed contact, and the second active contact element 60, with its terminal 61, has no contact with the fixed contact element 40 and therefore is a normally open contact (NO).

Figure 36:
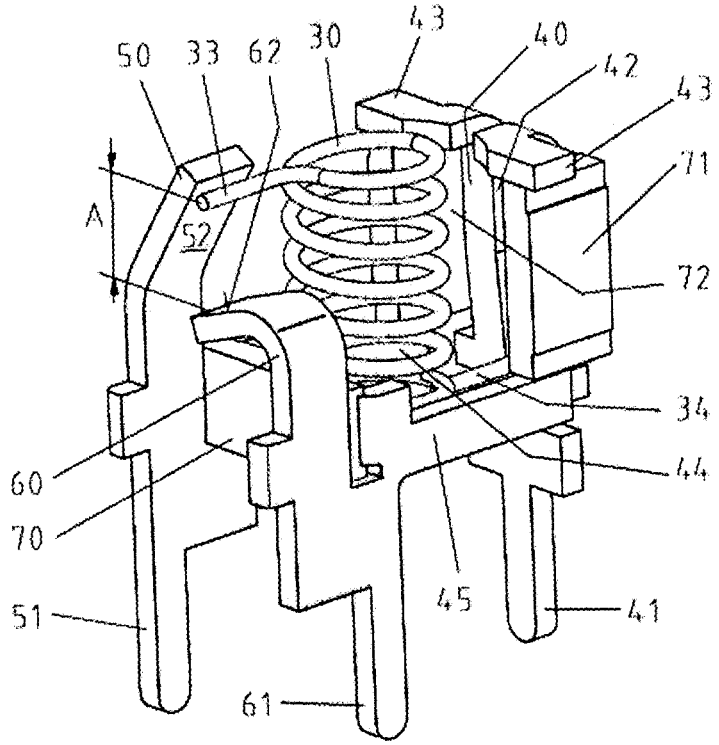
FIG. 36 is a perspective view of the switch in FIG. 35, in which the base of the switch housing is not shown.
Figure 37:
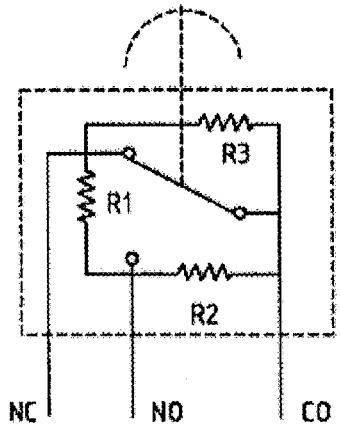
FIG. 37 is a circuit diagram of the switch in FIGS. 33 to 36.
Figure 38:
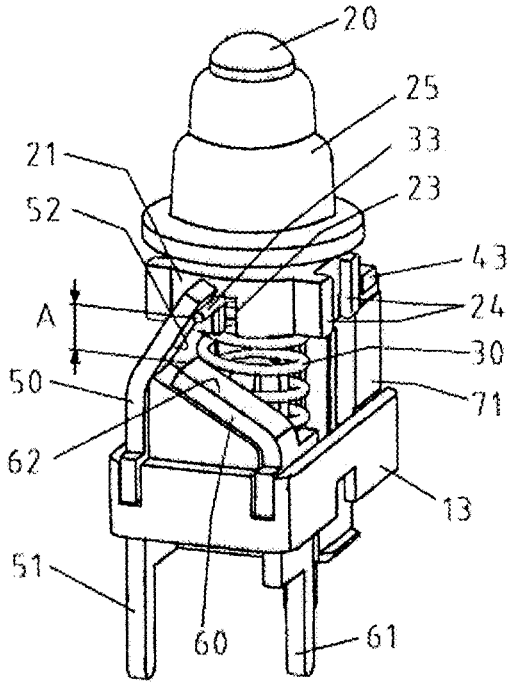
FIG. 38 shows a switch according to another embodiment of the present disclosure, in which the switch housing is not shown.

As can be seen more clearly in FIG. 31, the spring contact element 30 has a lower limb end 34 which is fixedly connected to the fixed contact 40, via a clamping connection or a soldered connection, for example. The upper part of the spring contact element 30, especially the upper limb end 33, is held in position by a receiving body 27 provided at bottom of the actuating element 20. As shown in FIG. 30, the upper part of the spring contact element 30 is received in a receiving channel 22 of the receiving body 27. The receiving channel 22 extends in the actuating direction X. The upper limb end 33 protrudes laterally through a slot 28 in the receiving body 27, rests against the contact surface 52 of the first active contact element 50 and is spaced from the contact surface 62 of the second active contact element 60 by a contact distance A, as shown in FIGS. 36 and 38. Preferably, the upper limb end 33 of the spring contact element 30 is pre-positioned in the actuating element 20, moves along a predetermined path, which is caused by a guided movement of the actuating element 20 in the actuating direction X, and reaches a predetermined contact position after moving a short distance. From the rest position to the actuated position, the actuating element 20 has a longer moving distance compared to the contact distance A. In the later stage of the movement, the upper limb end 33 of the spring contact element 30 experiences an overrun and slides on the contact surface 62 of the second active contact element 60. Thus, the upper limb end 33 is twisted. To ensure reliable contact and sufficient contact pressure of the upper limb end 33 on the second active contact member 60, the upper limb end 33 is pre-positioned in the receiving body 27 of the actuating element 20 under biasing force. In this example, the receiving body 27 has the slot 28 formed in the side wall thereof. The limb end 33 passes through the slot 28 and is positioned by the receiving body 27 of the actuating member 20 in a twisted manner such that sufficient biasing force can be obtained, which ensures reliable contact between the limb end 33 and the contact surface 62 of the second active contact element 60 and sufficient contact pressure can be applied onto the contact surface 62. The limb end 33 rests against the first active contact element 50 under the biasing force which provides sufficient contact pressure for the limb end 33 when the actuating element 20 is in the rest position. Thus during the movement of the actuating element 20 the limb end 33 does not lift off from the contact surface 52 or leave the contact surface 52 too early due to the spring force. After the actuation, the actuating element 20 is moved back to the rest position under the spring force of the spring contact element 30 and assistance of the bellow 25.

When the switch 4 is actuated, the upper limb end 33 of the spring contact element 30 passes the contact distance A along a given path under guidance. For this purpose, a guiding structure for the actuating element 20 is provided in the switch housing 10. As shown in FIG. 30, the guiding structure includes two pairs of guide ribs 24 on the outer surface of the receiving body 27. Each pair of guide ribs 24 are engaged into a groove in the switch housing 10. The groove may be formed by two guide strips 15 extending in the actuating direction X. Via the cooperation of the guide ribs 24 on the receiving body 27 of the actuating element 20 and the guide strips 15 of the switch housing 10, the movement of the actuating element 20 in the actuating direction X is predetermined. Thus the move path of limb end 33 held in the receiving body 27 is also predetermined. In addition, the lower part of the spring contact element 30 is held by a protrusion 14 formed on the base 13 of the switch housing 10. The protrusion 14 snaps into the spring contact element 30 from below. The lower limb end 34 may be engaged into a slot 42 in the fixed contact element 40, as shown in FIG. 31. Optionally the limb end 34 may be integrally formed with the contact element 40. It is understandable that the limb end may be fixed to the contact element by other means.

Figure 32:
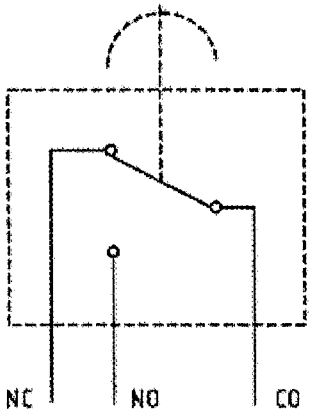
FIG. 32 is a circuit diagram of the switch in FIG. 29.
Figure 33:
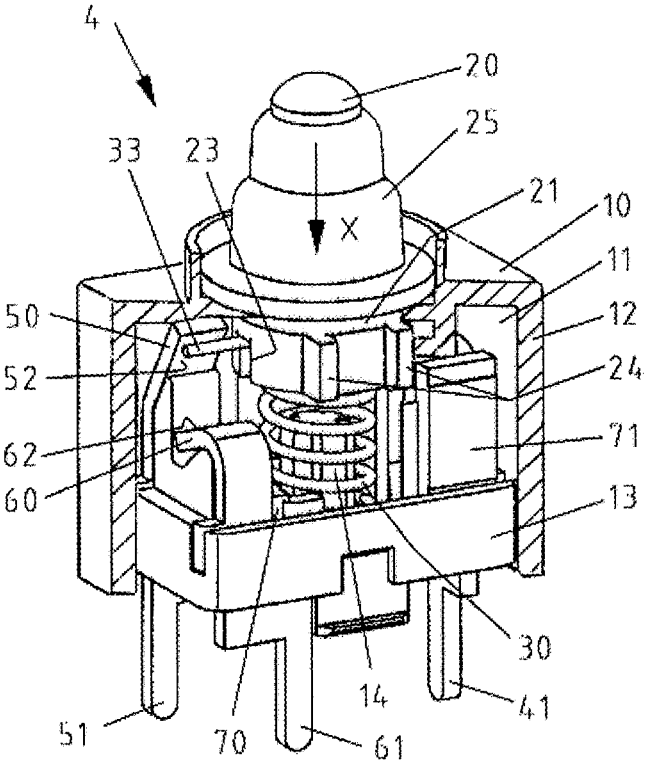
FIG. 33 shows a switch according to another embodiment of the present disclosure, in which a resistor is incorporated.

FIG. 32 illustrate a circuit diagram of the switch 4 of FIGS. 29 to 31.

FIGS. 33 to 36 illustrate another example of the switch 4. Series-connected resistors 70, 71, 72 are partly or all arranged in the switch 4, as shown in the circuit diagram in FIGS. 37, 39 and 40. The resistors 70, 71, 72 are preferably SMD resistors and fixed to the contact elements 40, 50, 60, for example via a soldered connection, via a welded connection preferably by means of laser, or via a clamping connection. By measuring the circuit, in particular by measuring the resistance, the state of the contact can be determined. The resistance of the resistors 70, 71, 72 may be different. FIGS. 33 to 38 illustrate the configuration with three resistors 70, 71 and 72. The first resistor 70 is connected between the first active contact element 50 and the second active contact element 60, the second resistor 71 is connected between the fixed contact element 40 and the second active contact element 60 and the third resistor 72 is connected between the fixed contact element 40 and the first active contact member 50. The contact elements 40, 50 and 60 have arms 43, 44 and 45 for better contact with the resistors 70, 71 and 72.

Figure 39:
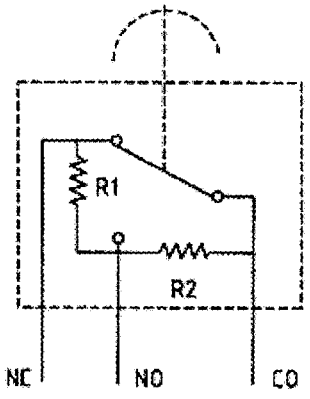
FIGS. 39 and 40 are two circuit diagrams of two switches according to two embodiments of the present disclosure, in each of which two resistors are incorporated.
Figure 40:
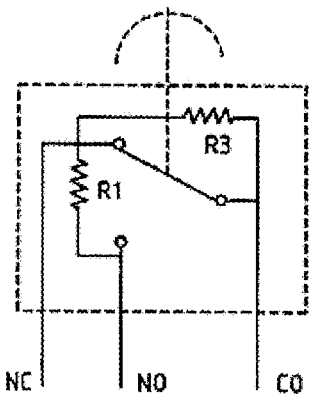

FIGS. 39 and 40 illustrate circuit diagrams only having two resistors. In FIG. 39 the resistor between the fixed contact element 40 and the first active contact element 50 has been removed. In FIG. 40 the resistor between the fixed contact element 40 and the second active contact element 60 has been removed.

Figure 34:
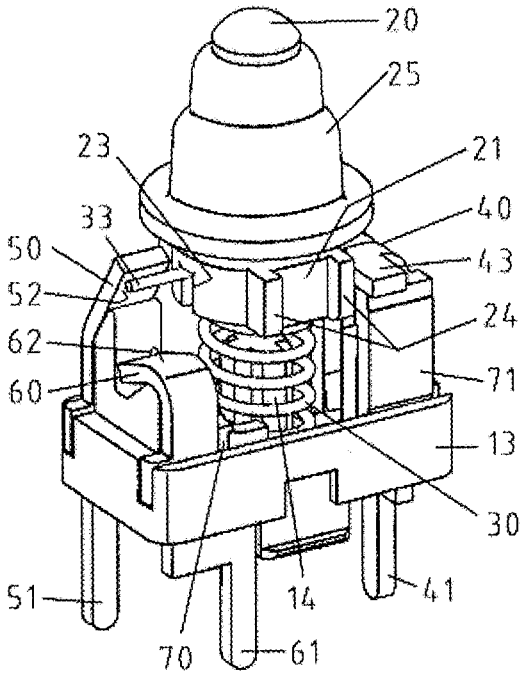
FIG. 34 is a perspective view of the switch in FIG. 33, in which the switch housing is not shown.
Figure 35:
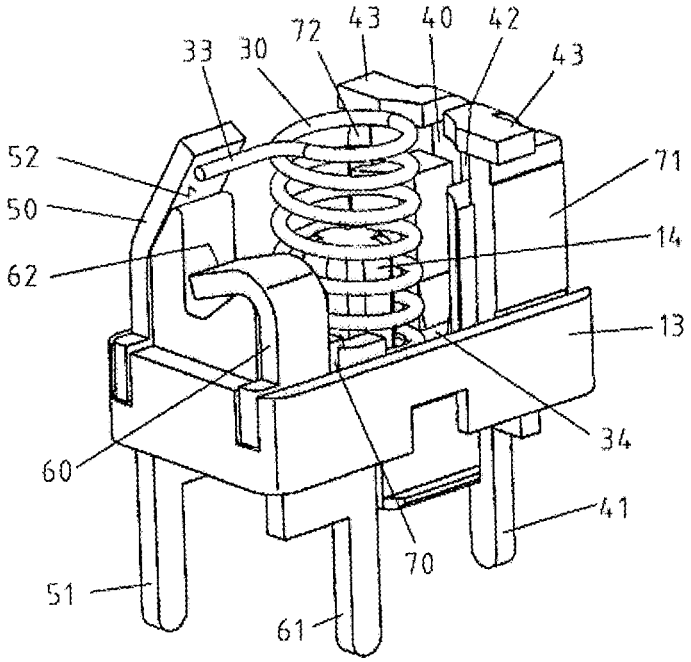
FIG. 35 is a perspective view of the switch in FIG. 34, in which the actuating element is not shown.

The difference between the switches 4 of FIGS. 34 and 38 lies in the second active contact elements 60. Bending of the two second active contact elements 60 is different, which changes the contact distance A and the switching time of the switch 4.

The above-described embodiments are only preferred embodiments of the disclosure, and are not intended to limit the disclosure. Any modification, equivalent replacement or improvement within the essence and principle of the present disclosure shall fall within the protection scope of the present disclosure.

The invention claimed is:

1. A switch comprising:

a switch housing having a receiving space;

a conductive fixed contact element and a conductive active contact element which are provided in the receiving space and being electrically connected to two terminals of the switch respectively;

an actuating member reciprocating movable in a predetermined actuating direction between a rest position and an actuated position; and a conductive spring contact element movable with the actuating element, the spring contact element being in constant contact with the fixed contact element and switched between a state of being in contact with a conductive contact surface of the active contact element and a state of being disconnecting with the conductive contact surface of the active contact element, wherein the actuating element is moved back from the actuated position to the rest position due to spring force of the spring contact element;

wherein a resistor is connected in series between the spring contact element and the fixed contact element or between the spring contact element and the active contact element, the resistor being correspondingly assembled on the fixed contact element or the active contact element.

2. The switch according to claim 1, wherein the spring contact member includes a middle spring part and two limb ends extending from both sides of the middle spring part, one of the limb ends being stationary and in constant contact with the fixed contact element, the other one of the two limb ends being movable with the actuating member along a predetermined path to make contact or disconnect with the active contact element.

3. The switch according to claim 2, wherein the middle spring part is sleeved around a holding pin extending in a direction perpendicular to the actuating direction and the movable limb end is movable in the actuating direction to make contact or disconnect with the active contact element.

4. The switch according to claim 2, wherein the middle spring part is sleeved around a holding pin extending in a direction perpendicular to the actuating direction and the movable limb end is movable in the direction perpendicular to the actuating direction to make contact or disconnect with the active contact element.

5. The switch according to claim 2, wherein the actuating element has a receiving body at the bottom thereof, one of the two limb ends being positioned in the receiving body in a twisted manner under the biasing force of the spring contact element when the actuating element is in the rest position and being further twisted when the actuating member is manipulated.

6. The switch according to claim 2, wherein the middle spring part is sleeved around a holding pin extending in a direction parallel to the actuated direction, the movable limb being movable in the direction perpendicular to the actuating direction to make contact or disconnect with the active contact element.

7. The switch according to claim 1, wherein the contact of the spring contact element with the active contact element is a sliding contact along the conductive contact surface.

8. The switch according to claim 7, wherein the conductive contact surface is parallel to, perpendicular to, or angled with respect to the actuating direction.

9. The switch according to claim 1, wherein the conductive contact surface or the switch housing is provided with a haptic sensing structure.

10. The switch according to claim 1, wherein the contact surface has a first contact area extending in a direction inclined with respect to the actuating direction and a second contact area extending in the actuating direction.

11. The switch according to claim 2, wherein the movable limb is provided with a plurality of contact points or contact surfaces.

12. The switch according to claim 2, wherein the switch is a normally open switch, the movable limb being spaced from the contact surface of the active contact element by a predetermined contact distance when the actuating element is in the rest position.

13. The switch according to claim 12, wherein the moving distance of the actuating element in a direction from the resting position to the actuated position is greater than the contact distance between the movable limb and the contact surface of the active contact member.

14. The switch according to claim 2, wherein the switch is a normally closed switch, the movable limb being in contact with the active contact element when the actuating element is in the rest position.

15. The switch according to claim 1, wherein the active contact element is a first active contact element and the switch is a change-over switch and further comprises a second active contact element which is electrically isolated from the first active contact element and electrically connected to another terminal of the switch, the spring contact element moving with the actuating member to switch between contact with the first active contact element and contact with the second active contact element.

16. The switch according to claim 15, wherein a moving distance of the actuating element in a direction from the resting position to the actuated position is greater than a contact distance between the contact surface of the first active contact element and the contact surface of the second active contact member.

17. The switch according to claim 15, wherein the switch is provided with a plurality of resistors mounted on a part of or all of the fixed contact element and the first and second active contact elements.

* * * * *